US010122123B1

(12) United States Patent
Tsfasman et al.

(10) Patent No.: US 10,122,123 B1
(45) **Date of Patent: *Nov. 6, 2018**

(54) ELECTRICAL ARC PROTECTION USING A ROTATIONAL SHIELD

(71) Applicant: International Business Machines Corporation, Armonk, NY (US)

(72) Inventors: Arkadiy Tsfasman, Wappingers Falls, NY (US); John Werner, Fishkill, NY (US); Byron Green, Poughkeepsie, NY (US); Jeffrey A. Newcomer, Poughkeepsie, NY (US); Robert Mullady, Ulster, NY (US); William Brodsky, Binghamton, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/643,686

(22) Filed: Jul. 7, 2017

(51) Int. Cl.
*H01R 13/53* (2006.01)
*H01R 13/648* (2006.01)

(52) U.S. Cl.
CPC ..... *H01R 13/6485* (2013.01); *H01R 13/53* (2013.01)

(58) Field of Classification Search
CPC ..... H01R 24/76; H01R 4/48; H01R 13/6485
USPC ..... 439/186, 188, 181; 200/51.09
See application file for complete search history.

(56) References Cited

U.S. PATENT DOCUMENTS 2,922,054 A 1/1960 Miller
3,453,403 A 7/1969 Hoffman
3,477,001 A 11/1969 Haas et al.
3,599,167 A * 8/1971 Adrian ..... H01R 13/633 200/51.09
4,283,100 A 8/1981 Griffin et al.
4,331,998 A 5/1982 Matsko et al.
4,345,122 A 8/1982 Janniello
4,346,419 A 8/1982 Janniello
4,429,935 A 2/1984 Lamb et al.
4,604,505 A 8/1986 Henninger
4,681,385 A * 7/1987 Kruger ..... H01R 24/76 439/186
4,748,355 A 5/1988 Anderson et al.
(Continued)

FOREIGN PATENT DOCUMENTS

CN 103956619 A 7/2014
CN 205029123 U 2/2016
(Continued)

OTHER PUBLICATIONS

Tsfasman et al., "Electrical Arc Protection Using a Rotational Shield", U.S. Appl. No. 15/889,294, filed Feb. 6, 2018.
(Continued)

*Primary Examiner* — Abdullah Riyami
*Assistant Examiner* — Nader Alhawamdeh
(74) *Attorney, Agent, or Firm* — Michael Purdham

(57) ABSTRACT

Embodiments of the present disclosure include a plug and receptacle. The receptacle may be configured to receive power and may include two or more sockets configured to electrically couple to two or more pins of the plug. A shorting contact included in the receptacle may be configured to contact two sockets of the two or more sockets. Further, shielding ribs included in the receptacle may be configured to block the shorting contact from contacting the two sockets.

20 Claims, 13 Drawing Sheets

(56) References Cited

U.S. PATENT DOCUMENTS

| | | | | |
|---|---|---|---|---|
| 4,907,985 | A | 3/1990 | Johnsen | |
| 4,937,482 | A | 6/1990 | Dohogne | |
| 5,017,818 | A | 5/1991 | Dohogne | |
| 5,185,705 | A | 2/1993 | Farrington | |
| 5,249,976 | A | 10/1993 | Brock | |
| 5,298,701 | A | 3/1994 | Sandor | |
| 5,476,392 | A | 12/1995 | Inaba et al. | |
| 5,507,664 | A | 4/1996 | Carmo | |
| 5,602,427 | A | 2/1997 | Dimitriev | |
| 5,711,681 | A | 1/1998 | Hasegawa | |
| 5,818,671 | A | 10/1998 | Seymour et al. | |
| 5,835,567 | A | 11/1998 | Woods | |
| 6,341,967 | B1 | 1/2002 | Nabeshima et al. | |
| 6,406,328 | B1 | 6/2002 | Attarian et al. | |
| 6,619,970 | B2 | 9/2003 | Fukushima et al. | |
| 6,746,275 | B2 | 6/2004 | Yamakawa et al. | |
| 6,793,510 | B2 | 9/2004 | Yamakawa et al. | |
| 7,001,196 | B1 | 2/2006 | Huang | |
| 7,066,749 | B2 | 6/2006 | Borrego Bel et al. | |
| 7,134,919 | B2 | 11/2006 | Putz | |
| 7,422,491 | B2 | 9/2008 | Gherardini | |
| 7,431,601 | B2 | 10/2008 | Nugent, Jr. et al. | |
| 7,817,055 | B1 | 10/2010 | Scanlon | |
| 7,955,102 | B2 | 6/2011 | Santos | |
| 8,192,212 | B2 * | 6/2012 | Casses | B60L 11/1818 439/181 |
| 8,193,445 | B2 | 6/2012 | Li | |
| 8,379,375 | B2 | 2/2013 | Furuya et al. | |
| 8,382,505 | B2 | 2/2013 | Park | |
| 8,460,027 | B2 | 6/2013 | Topolewski | |
| 8,616,915 | B2 | 12/2013 | Funamura | |
| 9,085,240 | B2 | 7/2015 | Rathmacher | |
| 9,189,931 | B2 | 11/2015 | Kao | |
| 9,260,080 | B2 | 2/2016 | Maguire et al. | |
| 9,853,400 | B1 | 12/2017 | Brodsky | |
| 9,893,455 | B1 * | 2/2018 | Brodsky | H01R 13/44 |
| 2002/0079993 | A1 | 6/2002 | Toepfer | |
| 2007/0097582 | A1 | 5/2007 | Shipp et al. | |
| 2008/0242149 | A1 | 10/2008 | Konno et al. | |
| 2010/0323542 | A1 * | 12/2010 | Boucher | H01R 13/4532 439/137 |
| 2012/0149221 | A1 | 6/2012 | Huang | |
| 2013/0088798 | A1 | 4/2013 | Ikeno et al. | |
| 2013/0148249 | A1 | 6/2013 | Schlollerer et al. | |
| 2013/0301165 | A1 | 11/2013 | Ford et al. | |
| 2013/0323954 | A1 | 12/2013 | Eckel et al. | |
| 2016/0181731 | A1 * | 6/2016 | Lehmann | H01R 13/648 439/108 |

FOREIGN PATENT DOCUMENTS

| | | | |
|---|---|---|---|
| CN | 205646236 | U | 10/2016 |
| CN | 104103978 | B | 1/2017 |
| EP | 0367102 | A2 | 5/1990 |
| JP | 2013105563 | A | 5/2013 |

OTHER PUBLICATIONS

List of IBM Patents or Patent Applications Treated as Related, Feb. 1, 2018, 2 pgs.

Accelerated Examination Support Document, dated Dec. 20, 2017, 13 pages.

Brodsky et al., "Electrical Arc Protection Using a Trip Contact," U.S. Appl. No. 15/340,006, filed Nov. 1, 2016.

Brodsky et al., "Electrical Arc Protection Using a Trip Jumper," U.S. Appl. No. 15/340,021, filed Nov. 1, 2016.

List of IBM Patents or Patent Applications Treated as Related, Jun. 27, 2017, 2 pgs.

Brodsky et al, "Electrical Arc Protection Using a Trip Contact", U.S. Appl. No. 15/814,023, filed Nov. 15, 2017.

Brodsky et al, "Electrical Arc Protection Using a Trip Jumper", U.S. Appl. No. 15/813,858, filed Nov. 15, 2017.

List of IBM Patents or Patent Applications Treated as Related, Filed Nov. 15, 2017, 2 pages.

* cited by examiner

ELECTRICAL ARC PROTECTION USING A ROTATIONAL SHIELD

BACKGROUND

The present disclosure relates generally to the field of electrical power plugs and receptacles, and more particularly to preventing electrical arcs during connection of a plug to, and disconnection of a plug from, a receptacle.

Electrical power receptacles may be configured to transfer Alternating Current (AC) and/or Direct Current (DC) from external power sources (e.g., electric utility power, power generators, batteries) to electrical devices (e.g., server computers, refrigerators, washing machines, and microwaves) through plugs. Sockets of a receptacle may be configured to mate with pins of a plug, such that current may flow between the sockets and pins. This may be implemented to distribute power originating from an external power source to one or more electrical devices.

SUMMARY

Embodiments of the present disclosure include a plug and receptacle. The receptacle may be configured to receive power and may include two or more sockets configured to electrically couple to two or more pins of the plug. The receptacle may include a shorting contact configured to contact two sockets of the two or more sockets. The receptacle may further include shielding ribs, the shielding ribs being configured to block the shorting contact from contacting the two sockets.

The above summary is not intended to describe each illustrated embodiment or every implementation of the present disclosure.

BRIEF DESCRIPTION OF THE DRAWINGS

The drawings included in the present disclosure are incorporated into, and form part of, the specification. They illustrate embodiments of the present disclosure and, along with the description, serve to explain the principles of the disclosure. The drawings are only illustrative of typical embodiments and do not limit the disclosure.

Figure 1:
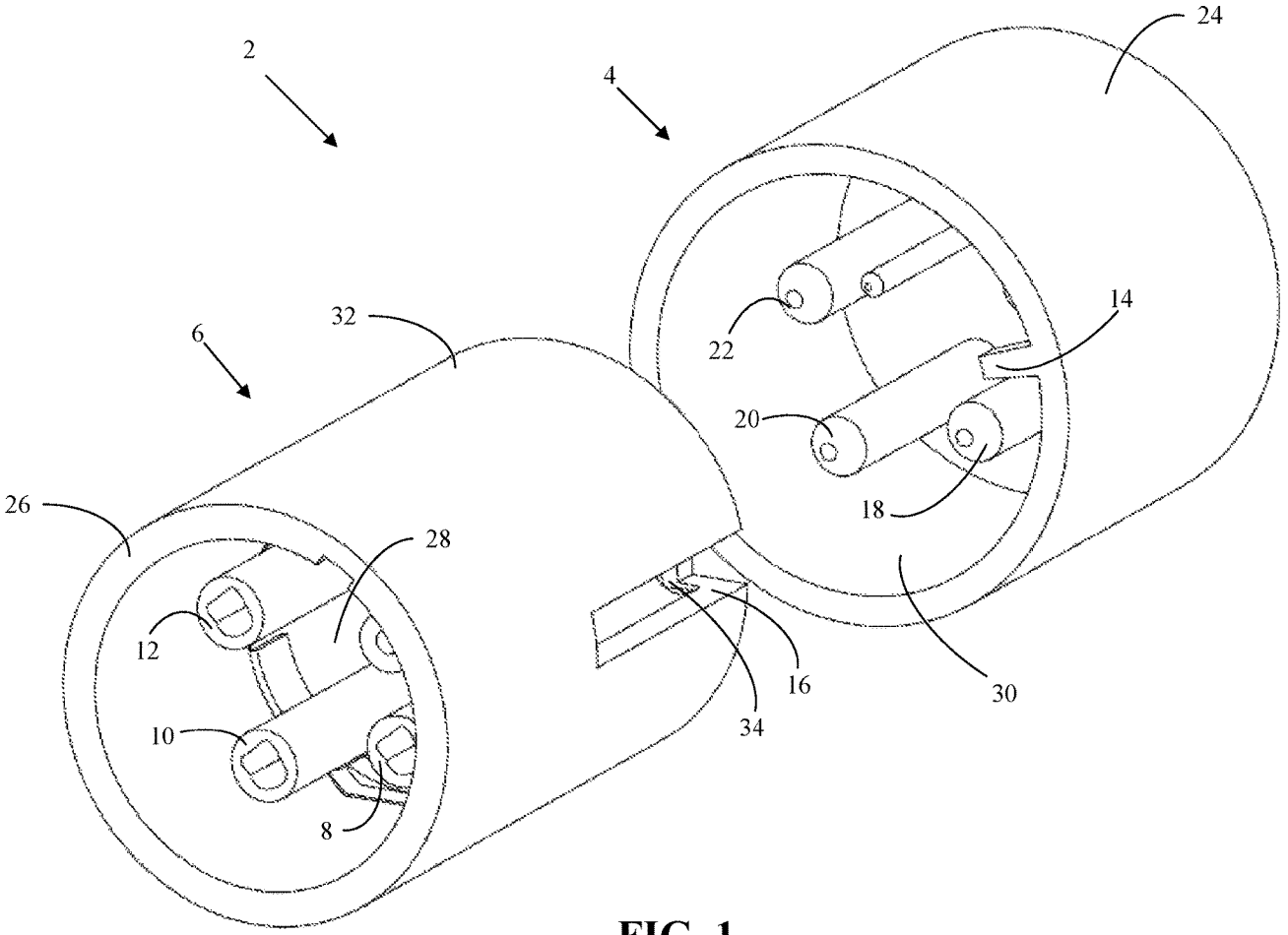
FIG. 1 illustrates a perspective view of a rotational shield power system, in accordance with embodiments of the present disclosure.

While the embodiments described herein are amenable to various modifications and alternative forms, specifics thereof have been shown by way of example in the drawings and will be described in detail. It should be understood, however, that the particular embodiments described are not to be taken in a limiting sense. On the contrary, the intention is to cover all modifications, equivalents, and alternatives falling within the spirit and scope of the invention.

DETAILED DESCRIPTION

The present disclosure relates generally to the field of electrical power plugs and receptacles, and more particularly to electrical power plugs and receptacles that prevent electrical arcs during connection of the plug to, and disconnection of a plug from, the receptacle. While the present disclosure is not necessarily limited to such applications, various aspects of the disclosure may be appreciated through a discussion of various examples using this context.

As used herein, "electrical device" refers to an electrical device capable of receiving alternating current (AC) and/or direct current (DC) electrical power (hereinafter, "power") from an external power source. Examples of electrical devices include electric motors, computers or computer chassis, computing system elements (e.g., compute nodes in a multi-node computer, storage devices or subsystems, network gateways, etc.), power transformation systems (e.g., AC to DC transformer, DC to AC inverters, DC-to-DC converters, AC transformers, etc.), and so forth.

An external power source for an electrical device may be electric utility power, other sources of power provided within a building (e.g., from a battery backup, generator, or capacitor), and/or rectified (e.g., AC to DC) power (whether utility or other sources). An electrical power source may be a mobile power source, such as a vehicle-mounted or another mobile electrical power generator. An external power source may be, for example, a power distribution rack. Such a rack may receive utility power from another power source and provide receptacles to plug electrical devices such as, for example, a computer or nodes of a multi-node computer or computing system. As used herein, "facility" refers to any such source of power to which an electrical device can connect to receive power.

Conventionally, a plug at one end of a line cord (e.g., power cord) connected to an electrical device may connect to a facility receptacle (e.g., an outlet) to receive facility power to provide to the device. A facility receptacle (hereinafter, "receptacle") is typically associated with the facility itself, such as attached to, or built into, a facility wall or power distribution chassis. A line cord and plug are then typically associated with an electrical device to connect to the receptacle to draw facility power. In some embodiments, the plug and receptacle may include mating power contacts of particular electrical polarities, such as AC and/or DC positive and negative polarity contacts, AC neutral polarity contacts, individual phase polarity contacts in a multi-phase AC power facility, and/or ground polarity contacts.

A plug and receptacle may interconnect by various means, such as pins on a plug mating with sockets of a receptacle. While a plug can include pins, and a receptacle can include sockets, the receptacle may, alternatively, include pins (sometimes recessed within a cavity into which a plug inserts) and the plug may include sockets. Other embodiments of receptacles and plugs can include other forms or types of contact points, such as raised or sliding metal contacts on each of the plug and receptacle designed to mate to each other when the plug is connected to the receptacle. It would be apparent to one of ordinary skill in the art that a contact can be any form or design of an electrically conductive surface on each of a plug and receptacle that can mate when the plug and receptacle are connected.

As used herein, "plugging action" refers to any action connecting or disconnecting a plug from a receptacle. While it can be the case that facility power is disconnected, or shut off, from a receptacle prior to a plugging action, performing a plugging action while the receptacle is energized (i.e., receiving power) can occur. As used herein, a "hot plug" or "hot unplug" or, interchangeably, "hot plugging" or "hot unplugging," respectively, action refers to a plugging action performed while the receptacle is connected to and receiving power (e.g., one or more power contacts in the receptacle are connected to a facility power source).

Hot plug and hot unplug actions can present electrical safety hazards. For example, when connecting a plug to, or disconnecting a plug from, an energized receptacle (referred to herein, respectively, as a "connection event" and "disconnection event"), a sudden, uncontrolled surge of power to the electrical device can result in injury to a human performing the hot plug or hot unplug action, and/or damage to the device, the plug and/or receptacle, or other equipment within or connected to facility power.

As another example, during a connection event, as power contacts (e.g., pins) of the plug get within a particular distance of energized receptacle power contacts (e.g., sockets), prior to the plug and receptacle power contacts making physical contact with each other, an uncontrolled electrical "arc" (hereinafter, "arc") may occur through the intervening air between the plug contacts and receptacle contacts. Similarly, when disconnecting a plug from an energized receptacle, as power contacts (e.g., pins) of the plug break physical connection with energized power contacts (e.g., sockets) of a receptacle, an uncontrolled arc can occur between plug and receptacle power contacts. In both cases, the flow of electric charge through a normally non-conductive medium (e.g., air) into a nearby conductive material can pose an electrical safety hazard.

An equation known as "Paschen's Law" gives the voltage necessary to start an electric arc in a gas as a function of pressure and gap length. A connection event involving high voltage AC or DC power (e.g., 120 to 480 Volts AC, or 380 to 520 Volts DC) can result in an arc between power contacts of a plug and receptacle at small distances (e.g., within about a millimeter) between them. Arcs associated with a connection event can pose electrical hazards but may be contained in (e.g., the electrical arc held within) the space between the plug and receptacle and extinguished as the plug and receptacle make full contact.

In contrast, an arc associated with a disconnection event may be drawn out and away from the receptacle. As contact is broken between a plug and an energized receptacle, an effect known as the Townsend Avalanche may result in electrical arcs, at the voltage of the facility power, extending outward from the receptacle to the plug for several millimeters and, correspondingly, can energize nearby conductive devices or materials, or a human performing a hot disconnection action. Such arcs can deliver potentially instantaneous high current flow, outside of the receptacle, which can pose a risk of electrocution, or damage to other nearby devices. Accordingly, embodiments of the disclosure may prevent an electrical arc when connecting or disconnecting a plug and receptacle when the receptacle, and/or power contacts within the receptacle, are energized.

Further, traditionally, sockets of the receptacle may be exposed when a plug is not coupled to the receptacle. If a human or object comes in close contact with the sockets of the receptacle, electrical discharge may occur, which may pose a risk for electrocution or damage to nearby objects. Embodiments of the present disclosure may prevent or lower the risk for electric shock or damage by restricting access to the sockets of the receptacle when a plug is not connected to the receptacle.

Embodiments disclose a rotational shield power system for protecting against arcs. A rotational shield disposed within a receptacle may include shielding ribs and a shorting contact. The shorting contact may be configured to short sockets (e.g., also referred to as a short circuit event) within the receptacle upon entry of a plug into, and disconnection of the plug from, the receptacle while the receptacle is drawing power. Triggering a short circuit event may trip an upstream circuit breaker, which may disconnect power to the receptacle prior to an air gap between pins of the plug and sockets of the receptacle being sufficiently small to allow arcing. This may prevent an arc spawning between pins of the plug and sockets of the receptacle. However, in a fully plugged or unplugged configuration (e.g., when the plug is fully mounted into the receptacle, or fully removed from the receptacle), the shielding ribs may be configured to block the shorting contact from contacting the sockets.

The plug may, in some embodiments, cause the rotational shield to rotate through an actuation key, and may vary the orientation of the shielding ribs with respect to the shorting contact, thus causing a short circuit event during a plugging action, and blocking a short circuit event in a fully unplugged/plugged configuration. In other words, in some embodiments, the shielding ribs may allow the shorting contact, which is contained within the receptacle, to electrically connect (e.g., touch) the sockets while the plug is being connected or disconnected. Accordingly, if power to the receptacle is left on while the plug is being connected or disconnected from the receptacle, the shorting contact will cause a short and trip a fuse/breaker, preventing an arc from forming between the pins and the sockets. Meanwhile, when the plug is fully connected or fully disconnected from the receptacle, the shielding ribs may block the shorting contact from electrically contacting the sockets, preventing a shorting event from tripping the fuse and allowing current to pass through the sockets into the pins and, ultimately, into the device that is drawing power.

Further, the rotational shield may include rotational pin holes which may be offset from the sockets of the receptacle in a fully unplugged configuration. This may prevent access to the sockets when the plug is not coupled to the receptacle. For example, the rotational pin holes may block access to the socket when the plug is fully disconnected from the receptacle. As the plug is inserted in to the receptacle, the rotational shield may begin to rotate. The rotation of the rotational shield may cause the rotational pin holes to align with the sockets, creating a channel through which the pins may pass to contact the sockets.

FIG. 1 illustrates a perspective view of a rotational shield power system 2 including a plug 4 and a receptacle 6, in accordance with embodiments of the present disclosure. The plug 4 may include a positive polarity pin 18, a negative polarity pin 20, and a ground pin 22 (hereinafter collectively referred to as pins) mounted within a plug housing 24. The receptacle 6 may include a positive polarity socket 8, a negative polarity socket 10, and a ground socket 12 (hereinafter collectively referred to as sockets) disposed within a stationary housing 26. The pins of the plug 4 may be configured to electrically couple to sockets of the receptacle 6. The receptacle 6 may receive facility power, and may be configured to transfer the facility power to pins of the plug 4 through the sockets. The plug 4 may then be configured to provide power to one or more electrical devices.

As shown in FIG. 1, the plug 4 may be configured to envelope the receptacle 6, such that an inner surface 30 of the plug housing 24 overlaps an outer surface 32 of the stationary housing 26. This may provide protection against electrical discharge when connecting the plug 4 to the receptacle 6, as the pins may be enclosed when mating to the sockets of the receptacle 6 and the plug 4 may include an electrically insulating material (e.g., rubber). In some embodiments, the plug 4 may be flush to the receptacle 6 (e.g., not overlap) upon connection of the pins to the sockets. In these embodiments, the pins may extrude out of the plug housing 24. Likewise, in these embodiments, the sockets of the receptacle may extrude out of the stationary housing 26. In some embodiments, the receptacle 6 may envelope the plug 4. However, any other suitable manner of coupling the plug 4 to the receptacle 6 may be implemented.

The plug housing 24 may further include an actuation key 14 to facilitate alignment of the plug 4 to the stationary housing 26 of the receptacle 6. The actuation key 14 may be complementary to an actuation track 16 on the stationary housing 26, and may slide within the length of the actuation track 16 upon insertion of the plug 4 into the receptacle 6. The actuation key 14 may further engage a rotational shield 28 within the stationary housing 26 through a rotational shield track 34. Accordingly, the actuation key 14 may simultaneously engage the rotational shield track 34 of the rotational shield 28 and actuation track 16 of the stationary housing 26. The rotational shield track 34 may be curved along its distance, such that insertion of the actuation key 14 into the rotational shield track 34 causes the rotational shield 28 to rotate along a pitch of the rotational shield track 34.

As the actuation key 14 rotates the rotational shield 28 along the pitch of the rotational shield track 34, a short circuit event may be internally engaged within the receptacle 6 and may trip an upstream circuit breaker, thereby severing power to the receptacle 6. The short circuit event may be engaged upon entry of the plug 4 into the receptacle 6, prior to the pins engaging the sockets (e.g., hot plug protection). Further, the short circuit event may be engaged while the pins are still electrically coupled to the sockets, prior to being fully disconnected (e.g., hot unplug protection). The hot unplug protection may only trip the fuse when the plug 4 is partially connected to the receptacle 6, such as while the plug 4 is being removed. However, the short circuit event may not occur when the plug 4 is fully connected to the receptacle 6 (e.g., within a threshold distance). Accordingly, the short circuit event may be engaged prior to an air gap suitable to cause an arc forming between the pins and sockets. This may be completed to prevent an arc spawning within an air gap between the pins and sockets while power is provided to the receptacle 6, as the upstream circuit breaker may disconnect power to the receptacle 6 prior to the occurrence of the arc.

For example, during a plugging action with power, the actuation key 14 of the plug 4 may rotate the rotational shield 28 through the rotational shield track 34 thereby causing a short circuit event. Because power is provided to the receptacle 6, the internal short circuit event may trip an upstream circuit breaker, and sever power flow to the receptacle 6 prior to an arc spawning between the pins and the sockets (e.g., prior to the pins being close enough to the sockets for the arc to form).

Figure 2:
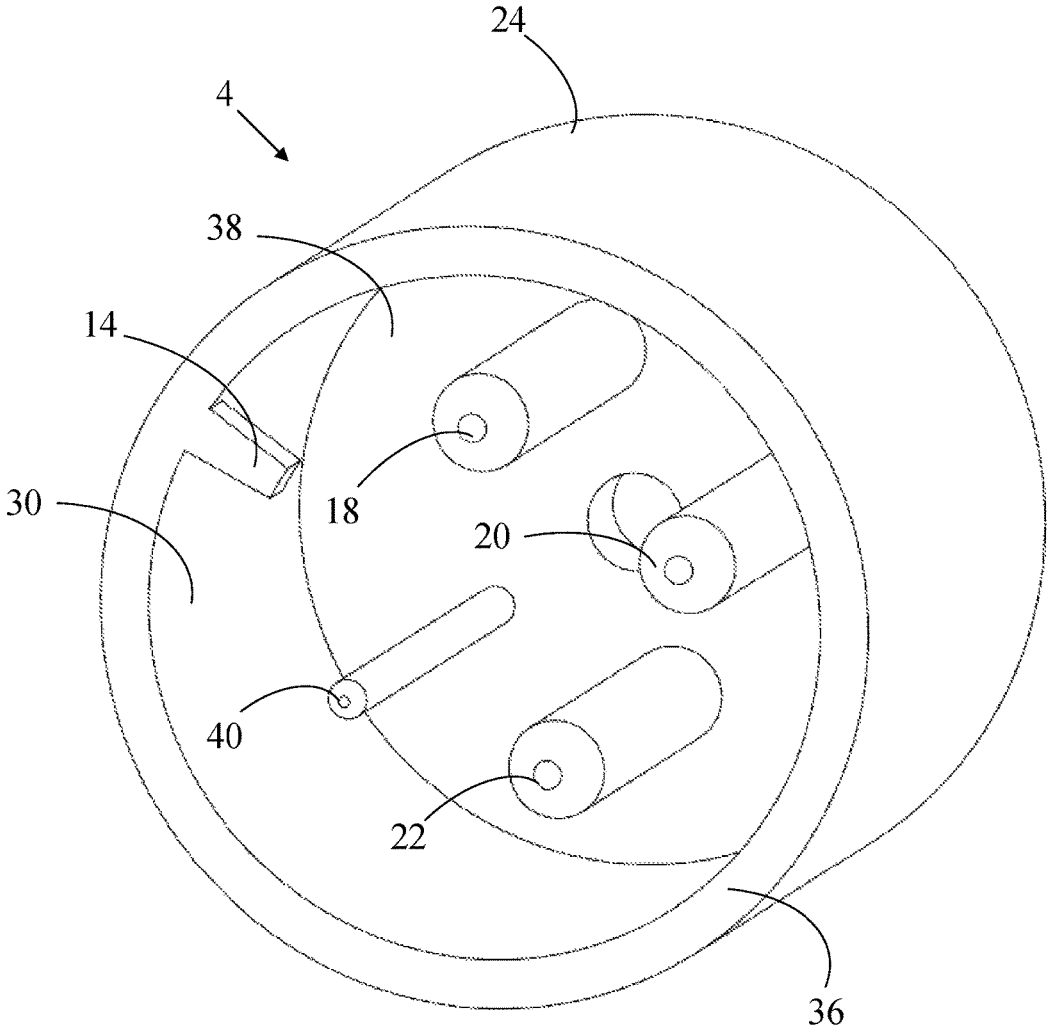
FIG. 2 illustrates a perspective view of a plug, in accordance with embodiments of the present disclosure.

FIG. 2 illustrates a perspective view of the plug 4, in accordance with embodiments of the present disclosure. As referred to in reference to FIG. 2, the receptacle, actuation track, rotational shield, rotational shield track, sockets, and stationary housing, which are not shown, may be substantially the same as the receptacle 6, actuation track 16, rotational shield 28, rotational shield track 38, sockets, and stationary housing 26 described in FIG. 1.

The plug 4 may include a plug housing 24 with an inner surface 30, a front end 36, and a back wall 38. The positive polarity pin 18, negative polarity pin 20, and ground pin 22 (collectively pins) may be mounted to the back wall 38 of the plug 4, such that the pins are anchored in place. In some embodiments, the pins protrude into holes disposed in the back wall 38, such that the holes of the back wall 38 exert force (e.g., static friction force) around the circumference of each pin sufficient to immobilize each pin within the plug 4. In these embodiments, the portion of each pin in contact with the back wall 38 (e.g., outer layer) may include a non-conductive region, such that electric flow through the pin is not impeded. However, the pins may be anchored to the plug housing 24 in any other manner.

The pins may be connected to a line wire (e.g., power cord) through the back wall 38, which may facilitate electricity transfer to one or more electrical devices. Though the pins shown in FIG. 2 include DC positive and negative polarity contacts, any other suitable polarity contact configuration for the plug 4 may be implemented, and the selected plug configuration may depend on the configuration of the receptacle. Alternative power contact configurations include, but are not limited to, AC neutral polarity contacts, individual phase polarity contacts in a multi-phase AC power facility, and/or ground polarity contacts. Further, any arrangement of pins on the plug may be implemented, and may depend on the structure of the receptacle. For example, in embodiments in which the receptacle only includes a positive polarity socket and a negative polarity socket, the plug 4 may only include a positive polarity pin 18 and a negative polarity pin 20.

The pins may be sized and shaped to facilitate connection to the sockets, and vice versa. In some embodiments, the pins may include a tapered end, to facilitate entry into the sockets. In some embodiments, the circumference of the internal edge of the sockets may correspond to the circumference of the pins. In some embodiments, the sockets may include a tapered end, to facilitate entry of the pins into the sockets. However, the size and shape of the pins and sockets may vary, and may be fabricated to facilitate convenient connection of the pins to the sockets.

The plug 4 may further include actuation key 14. As previously mentioned, the actuation key 14 may facilitate alignment of the plug 4 to the receptacle. Further, the actuation key 14 may guide the plug 4 through the actuation track of the receptacle. Additionally, the actuation key 14 may engage the rotational shield of the receptacle, thereby causing a short circuit event internally within the receptacle.

In the embodiment depicted on FIG. 2, the actuation key 14 may be disposed on the inner surface 30 of the plug housing 24 flush with the front end 36 of the plug housing 24. This may allow the actuation key 14 to engage the rotational shield prior to the pins coming in proximity with the sockets. This may be particularly advantageous in embodiments where the receptacle includes rotating pin holes that block access to the sockets until the rotational shield has rotated by a certain amount. However, the placement of the actuation key 14 may vary, and may depend on the configuration of the plug 4 and receptacle. For example, in embodiments where the receptacle encompasses the plug 4, the actuation key 14 may be placed on the outer surface of the plug housing 24. In embodiments where the pins are shorter (e.g., deeper within the plug housing 24), the actuation key 14 may be disposed toward the back wall 38 of the plug housing 24. Likewise, the size and shape of the actuation key 14 may vary, and may depend on dimensions of the plug 4 or receptacle. For example, the size and shape of the actuation key 14 may correspond to the size and shape of the actuation track and rotational shield track of the receptacle. It is to be understood that the size, shape, and placement of the actuation key 14 as shown in FIG. 2 is exemplary, and that any size, shape, or placement otherwise consistent with this disclosure is contemplated.

The plug 4 may further include an unlocking pin 40. The unlocking pin 40 may be configured to unlock a locking mechanism of the rotational shield of the receptacle, allowing it to freely rotate as the actuation key 14 moves through the pitch of the rotational shield track. In some embodiments, the unlocking pin 40 extrudes beyond the front end 36 of the plug housing 24. This configuration allows the unlocking pin 40 to unlock locking features present on the receptacle prior to the actuation key 14 entering the rotational shield track. In some embodiments, there may be an offset distance between the entrance of the actuation track and the rotational shield track. In these embodiments, the actuation key 14 and unlocking pin 40 may extend to the same distance, and the unlocking pin 40 may disengage the locking mechanism over this offset distance, such that the locking mechanism is unlocked prior to the actuation key 14 entering the rotational shield track. In other embodiments, there may not be an offset distance, and the actuation key 14 may be configured to move a distance within the receptacle prior to causing the rotational shield to rotate. The size, shape, and placement of the unlocking pin 40 may correspond to locking features present on the receptacle. In some embodiments, there may not be an unlocking pin 40, as the receptacle may not include a locking feature.

Figure 3:
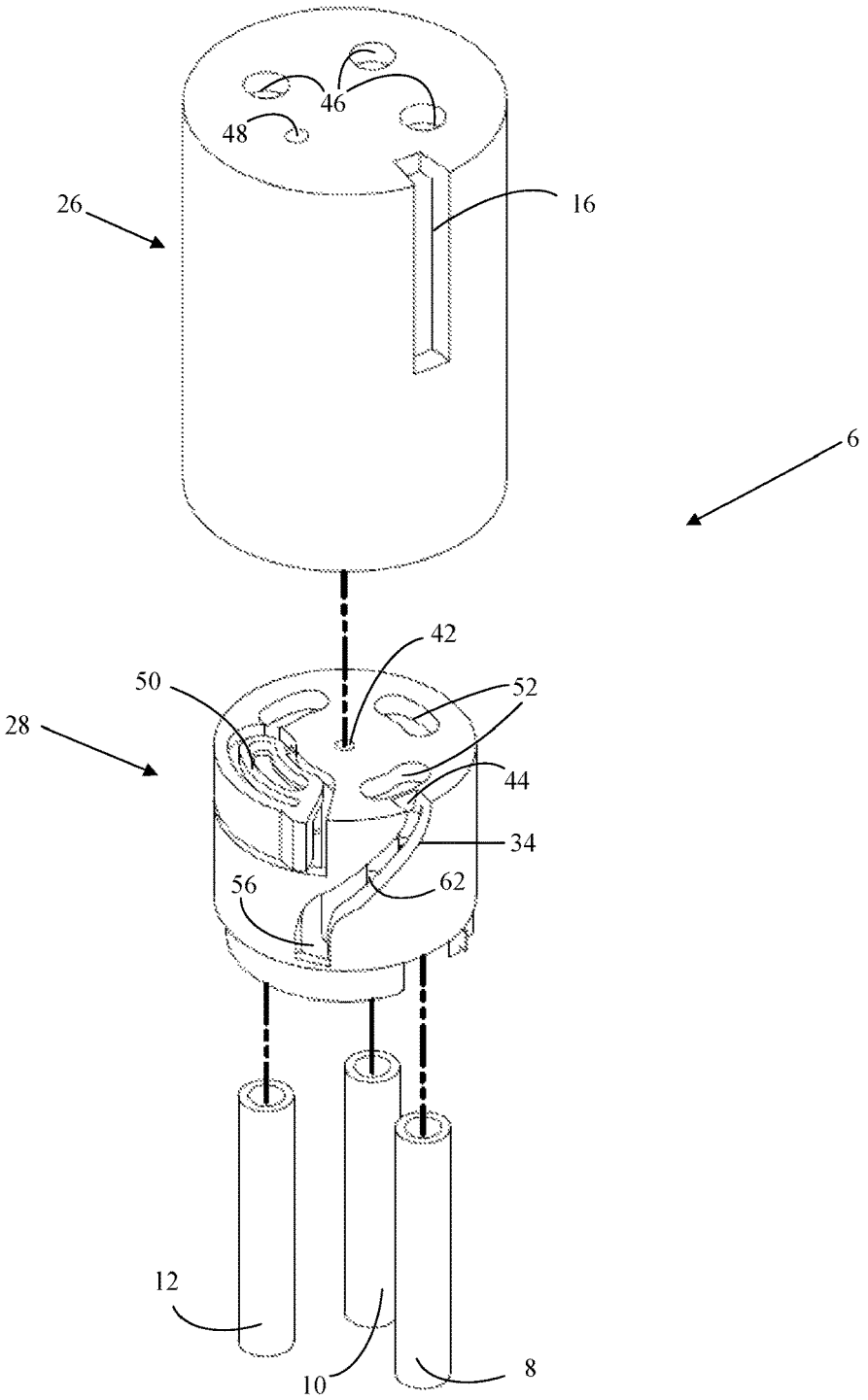
FIG. 3 illustrates an exploded view of a receptacle, in accordance with embodiments of the present disclosure.

FIG. 3 depicts an exploded view of the receptacle 6, in accordance with embodiments of the present disclosure. As previously mentioned, the receptacle 6 may include a stationary housing 26, a rotational shield 28, a positive polarity socket 8, a negative polarity socket 10, and a ground socket 12 (collectively sockets). As referred to in reference to FIG. 3, the plug, unlocking pin, pins, plug housing, and actuation key, which are not shown, may be substantially the same as the plug 4, unlocking pin 40, pins, plug housing 24, and actuation key 14 previously described (e.g., in reference to FIG. 1 and FIG. 2).

The stationary housing 26 may include pin holes 46 to permit pins of the plug to enter the receptacle 6. The size, shape, and placement of the pin holes 46 may correspond to the pins on the plug. Further, the number of pin holes 46 may be commensurate with the number of pins on the plug. The pin holes 46 of the stationary housing 26 may align with both the pins and the sockets, to permit the pins to mate with the sockets through the pin holes 46. Further, the stationary housing 26 may also include an unlocking pin hole 48. The unlocking pin hole 48 may correspond to the unlocking pin present on the plug. The unlocking pin hole 48 may be configured to allow the unlocking pin of the plug to engage a locking mechanism 50 of the rotational shield 28. The stationary housing 26 may also include the actuation track 16, which may correspond to the actuation key present on the plug. It is to be understood that the size, shape, placement, and number of features (e.g., pin holes 46, unlocking pin hole 48, and actuation track 16) present on the stationary housing 26, as depicted on FIG. 3, are exemplary, and any other size, shape, placement, or number of features otherwise consistent with this disclosure is contemplated. For example, the stationary housing 26 may include additional features (e.g., plates, screw holes, etc.) that allow the stationary housing 26 to be mounted within a building or facility (e.g., in a wall).

The rotational shield 28 may include rotating pin holes 52. The rotating pin holes 52 may be configured to be offset with pin holes 46 (e.g., and offset with the pins/sockets) of the stationary housing 26 in an unplugged configuration. The rotating pin holes 52 may be offset from the pin holes 46, such that the sockets are inaccessible when the plug is not attached to the receptacle 6. This may mitigate risk of electrocution to humans and/or damage to nearby devices or objects by preventing access to potentially electrified sockets. Upon insertion of the plug into the receptacle 6, the actuation key may cause the rotational shield 28 to rotate along a center point 42 according to a curve of a pitch region 62 of the rotational shield track 34. The rotational shield 28 may rotate until the actuation key reaches a plateau region 56 along the rotational shield track 34. At the plateau region 56, the pitch region 62 of the rotational shield track 34 ceases, and the pin holes 52 of the rotational shield may align directly with the pin holes 46 of the stationary housing 26, the sockets of the receptacle 6, and pins of the plug. This may allow the pins to mate with the sockets of the receptacle 6.

Further, the rotational shield 28 may include a locking mechanism 50. The locking mechanism 50 may be configured to lock the rotation of the rotational shield 28 along the center point 42 (e.g., prevent rotation). In some embodiments, the rotational shield 28 may be locked by locking mechanism 50 until the plug engages the receptacle 6. In these embodiments, upon entry of the plug into the receptacle 6, an unlocking feature on the plug (e.g., unlocking pin 40 as shown in FIG. 2) may be configured to unlock locking mechanism 50, thereby allowing the rotational shield 28 to rotate along the center point 42.

The rotational shield 28 may be disposed within a cavity (shown in FIG. 1) of the stationary housing 26. As shown in FIG. 3, the rotational shield 28 may follow a projection line (e.g., the projection line linking the rotational shield 28 to the stationary housing 26) to be included within the stationary housing 26. The rotational shield 28 may be coupled to the stationary housing 26 in any manner, such that the rotational shield 28 can rotate within the stationary housing 26. In some embodiments, the rotational shield 28 may be coupled to the stationary housing 26 through the center point 42. The center point 42 may be coupled to the stationary housing 26 through an axle, spindle, shaft, or any other structure sufficient to attach the rotational shield 28 onto the stationary housing 26 while allowing the rotational shield 28 to rotate. However, any other method of attaching the rotational shield 28 onto the stationary housing 26 may be implemented. In some embodiments, the rotational shield may include retractable appendages (e.g., pegs or rods) which correspond to tracks present on the stationary housing 26. In these embodiments, the appendages may move along the tracks while the rotational shield 28 rotates. Further, the appendages may be retractable, such that the rotational shield 28 may be removed from the stationary housing 26 (e.g., for replacement/repair).

The rotational shield 28 may be aligned with the stationary housing 26, such that the actuation track 16 of the stationary housing 26 aligns with an entry point 44 of the rotational shield track 34. Aligning the entry point 44 of the rotational shield track 34 with the actuation track 16 may allow the actuation key of the plug to enter/engage both the actuation track 16 and rotational shield track 34 simultaneously.

The receptacle may further include a positive polarity socket 8, a negative polarity socket 10, and a ground socket 12 (collectively sockets). The sockets may be immobilized within the rotational shield 28 and stationary housing 26. The sockets may be mounted within the receptacle in any suitable manner. In some embodiments, the sockets are mounted to surrounding structures (e.g., a chassis, wall, wires, or other surrounding hardware). In some embodiments, the sockets may be aligned with pin holes 46 of the stationary housing, and may be offset from rotating pin holes 52 of the rotational shield 28 (e.g., in the unplugged configuration). This may allow the sockets to mate with respective pins on the plug, when unobstructed by the rotational shield 28, allowing power transfer from the sockets to the pins. As depicted in FIG. 3, the sockets may follow projection lines to be positioned within a cavity in the rotational shield 28. After being positioned within a cavity in the rotational shield 28, the sockets may be mounted (e.g., immobilized) in any manner.

Figure 4:
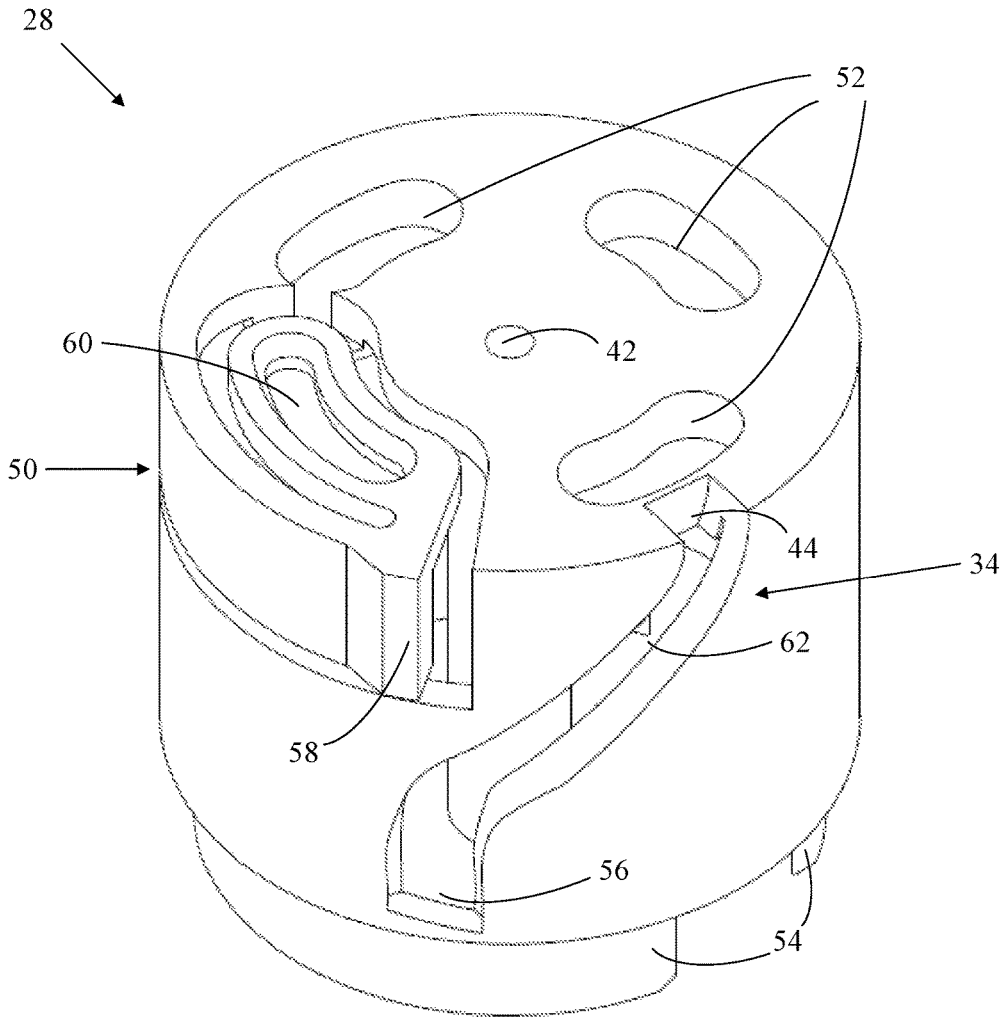
FIG. 4 illustrates a perspective view of a rotational shield, in accordance with embodiments of the present disclosure.

FIG. 4 illustrates a perspective view of the rotational shield 28, in accordance with embodiments of the present disclosure. As referred to in reference to FIG. 4, the pins, plug, sockets, receptacle, stationary housing, unlocking pin hole, and actuation key (not shown) may be substantially the same as the pins, plug 4, sockets, receptacle 6, stationary housing 26, unlocking pin hole 48, and actuation key 14 described elsewhere herein.

The rotational shield 28 may include one or more rotating pin holes 52. The rotating pin holes 52 may be sized and shaped to receive pins of the plug. In some embodiments, the rotating pin holes 52 may be elongated holes (e.g., as shown on FIG. 4). The rotating pin holes 52 may be elongated such that the rotating pin holes 52 maintain a uniform distance from the center point 42 at any rotational displacement within the rotating pin holes 52. This configuration allows the sockets of the receptacle to be accessible over a greater angular displacement of the rotational shield 28. However, the size, shape, and placement of the pin holes 52 may vary depending on the configuration of the plug and receptacle.

The rotational shield 28 may further include a locking mechanism 50. The locking mechanism 50 may be configured to lock rotation of the rotational shield 28. In some embodiments, the locking mechanism 50 may be configured to rotationally lock the rotational shield 28 when the plug is not coupled to the receptacle. As shown in FIG. 4, the locking mechanism 50 may include a locking latch 58 and unlocking pin receptacle 60. The locking latch 58 may rotationally lock the rotational shield 28 into the stationary housing when the plug is not coupled to the receptacle. To do so, the locking latch 58 may extrude radially outward from the rotational shield 28 into a crevice in the stationary housing (e.g., shown and discussed in reference to FIG. 5).

To engage the locking mechanism 50, an unlocking feature (e.g., unlocking pin 40 as shown on FIG. 2) may enter the unlocking pin hole of the stationary housing and unlocking pin receptacle 60 to force the unlocking latch 58 radially inward, out of the crevice of the stationary housing. This may allow the rotational shield 28 to freely rotate as the actuation key moves along the rotational shield track 34. In some embodiments, there may be an offset distance between the unlocking pin hole of the stationary housing and unlocking pin receptacle 60 of the rotational shield 28, such that the locking mechanism 50 superimposes the area within the unlocking pin hole of the stationary housing. This offset distance allows the unlocking pin of the plug to enter the unlocking pin hole of the stationary housing and force the locking latch 58 radially inward as the unlocking pin enters the unlocking pin receptacle 60 (see FIG. 5 for greater detail).

In some embodiments, the locking latch 58 may be manually retracted from the stationary housing, to permit rotational shield 28 rotation. In these embodiments, the locking latch 58 may be retracted in response to an event (e.g., such as the activation of a button, lever or switch). In these embodiments, a user may manually deactivate the rotational shield 28 locking mechanism 50 prior to a plugging action. In some embodiments, the locking mechanism may be deactivated in response to inserting the plug into the receptacle (e.g., as shown on FIG. 4).

Though a locking latch is depicted in FIG. 4, any other suitable locking mechanism 50 may be implemented. In some embodiments, the locking mechanism 50 may generate a force between the rotational shield 28 and stationary housing to prevent the rotational shield 28 from rotating along the center point 42. The locking mechanism may include implementation of adhesives, latches, electromagnetic forces, or static friction forces. In some embodiments, a magnetic locking mechanism may be implemented. In these embodiments, the locking mechanism 50 may include a magnet which may correspond to another magnet present on the stationary housing, such that a magnetic force prevents the rotational shield 28 from rotating. In these embodiments, an angular force exerted on the rotation shield (e.g., caused by the actuation key moving through the rotational shield track 34) may overcome the magnetic force, thereby allowing the rotational shield 28 to freely rotate.

The center point 42 may be sized and shaped to receive a projection. In some embodiments, the center point 42 may facilitate rotation of the rotational shield. In these embodiments, a circular projection may be implemented (e.g., a spindle, shaft, axle, rod, or similar feature) for attachment onto the stationary housing. However, any suitable size and shape of the center point 42 may be implemented, and may depend the received projection. For example, in embodiments in which a square projection is implemented, the center point 42 may be square.

The rotational shield 28 may further include shielding ribs 54. The shielding ribs 54 of the rotational shield 28 may block a short circuit event from occurring. Blocking the short circuit event through shielding ribs 54 may be based on an angular displacement. For example, based on the rotation of the rotational shield 28 through the rotational shield track 34, the shielding ribs 54 may block a short circuit event. In some embodiments, the short circuit event may be blocked when the plug is fully inserted (e.g., within a threshold or tolerance) into the receptacle and/or when the plug is fully disconnected from the receptacle. Accordingly, the shielding ribs 54 may be sized and shaped in order to block the short circuit event.

For example, in some embodiments, the shielding ribs may be wider (e.g., a greater distance from left to right on FIG. 4), to block the short circuit event over a greater angular rotation range. On the other hand, if the short circuit event is to occur over a greater angular rotational displacement, the shielding ribs 54 may be thinner (e.g., half the width). Further, in some embodiments, if a greater number of short circuit events are to occur over a given angular rotational displacement, a greater number of shielding ribs 54 may be implemented. However, any size, shape, placement, and/or number of shielding ribs 54 may be implemented, and may depend on what is required to block the short circuit event.

As previously mentioned, the actuation key of the plug may cause rotation of the rotational shield 28 by the actuation key moving through the rotational shield track 34. The rotational shield track 34 may include an entry point 44, a pitch region 62, and a plateau region 56. As the actuation key enters the entry point 44, it begins sliding through the pitch region 62 of the rotational shield track 34. The curve of the pitch region 62, along with the relative immobility of the actuation key caused by, for example, its connection to the stationary housing, causes the rotational shield 28 to rotate along the center point 42 (e.g., rotation is a degree of freedom). Eventually, the actuation key enters the plateau region 56 of the rotational shield track 34, at which the pitch region 62 ceases, and rotation of the rotational shield 28 ends.

The relative dimensions of the rotational shield track 34 may be sized and shaped to block the short circuit event. In some embodiments, the pitch region 62 may have a greater curve such that a greater number of short circuit events occur, such that the short circuit event(s) occur over a greater angular displacement, and/or such that the short circuit event(s) occur by implementing wider shielding ribs 54. Alternatively, in some embodiments, the pitch region 62 may have a smaller curve, such that a lesser number of short circuit events occur, such that the short circuit event(s) occur over a smaller angular rotational displacement, or such that the short circuit event(s) occur by implementing thinner shielding ribs 54. However, the relative dimensions of the rotational shield track 34 may vary, and may depend on what is required to block the short circuit event.

Figure 5:
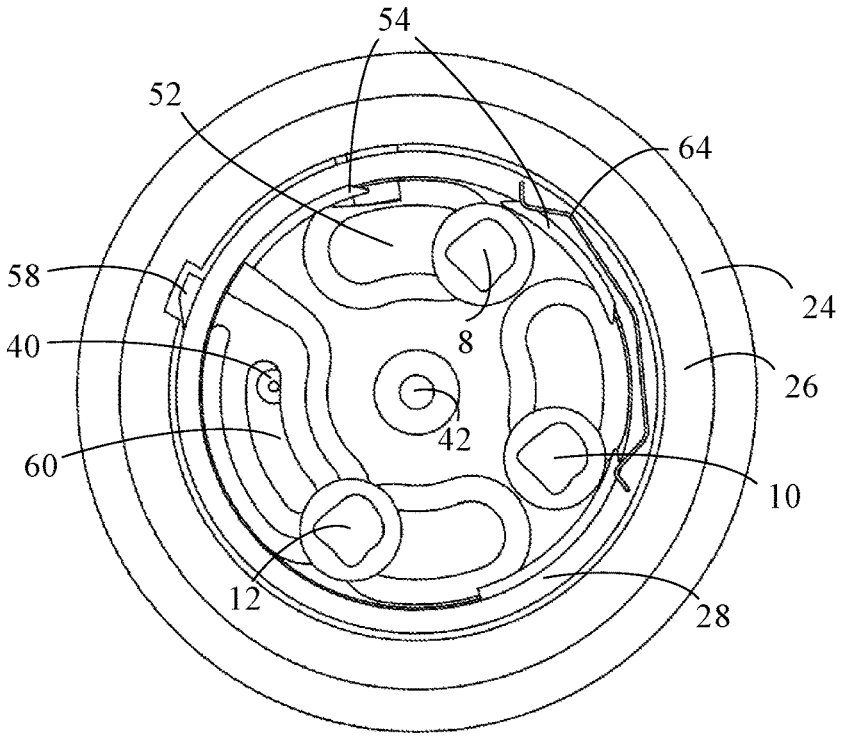
FIG. 5 illustrates a back view of the receptacle positioned to engage the plug, in accordance with embodiments of the present disclosure.
Figure 6:
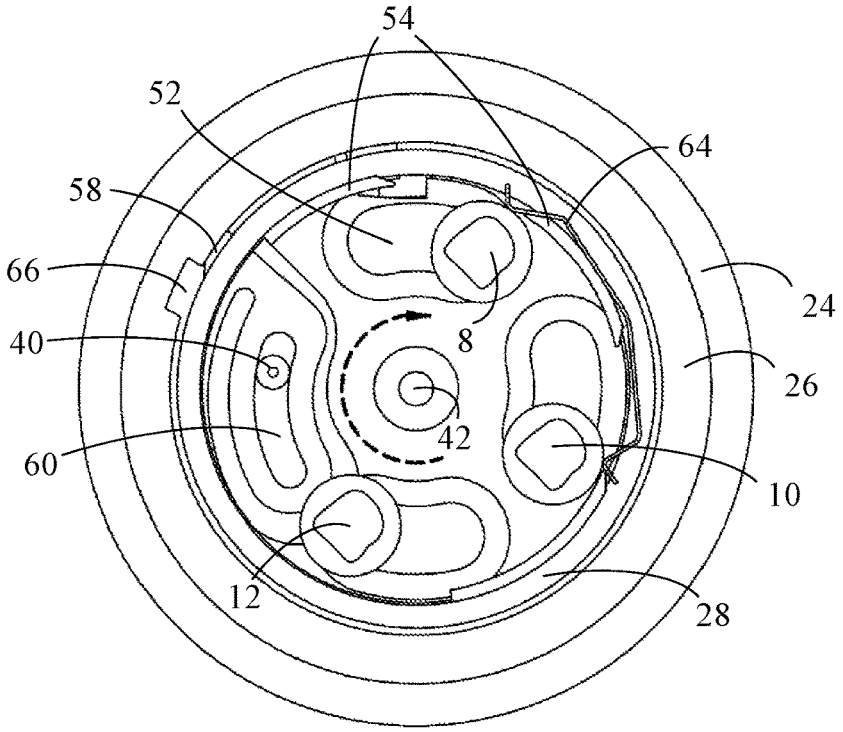
FIG. 6 illustrates a back view of the receptacle initially engaging the plug, in accordance with embodiments of the present disclosure.

Referring now to FIG. 5 and FIG. 6, shown is a before and after comparison of the plug initially positioned to enter the receptacle (FIG. 5), and the plug initially engaging the receptacle (FIG. 6), in accordance with embodiments of the present disclosure. FIG. 5 depicts a back view of the receptacle in position to be engaged by the plug, in accordance with embodiments of the present disclosure. FIG. 6 depicts a back view of the receptacle being initially engaged by the plug, in accordance with embodiments of the present disclosure. As described and referenced in FIG. 5 and FIG. 6 the receptacle, plug, pins, and unlocking pin hole (not shown) may be substantially the same as the receptacle 6, plug 4, pins, and unlocking pin hole 48 previously described.

As depicted in FIG. 5, the plug housing 24 may be in position to envelope the stationary housing 26 of the receptacle. However, the plug housing 24 has not yet come into contact with the stationary housing 26. Therefore, the configuration of the receptacle, as illustrated in FIG. 5, depicts the receptacle in an unplugged configuration. As depicted in FIG. 6, the plug housing 24 begins enveloping the stationary housing 26, and thus FIG. 6 illustrates the receptacle during a plugging action.

As previously mentioned, in some embodiments, a short circuit event may be internally triggered within the receptacle upon entry of the plug to the receptacle, prior to the pins becoming in proximity of the sockets such that an arc could spawn. The short circuit event may be configured to trip an upstream circuit breaker by allowing current to freely (e.g., with low resistivity) flow between two of the sockets, thus severing power to the receptacle. Specifically, in some embodiments, a short circuit event may be triggered prior to an air gap between the pins and sockets being small enough to allow arcing (e.g., which in this case represents a hot plug situation, tripping the circuit breaker prior to the pins becoming in close proximity with sockets such that an air gap of sufficient distance is formed with the potential to spawn an arc).

The receptacle may include shielding ribs 54 to block or allow a short circuit event caused by a shorting contact 64, depending on whether the plug is fully connected/disconnected from the receptacle or is in the process of being plugged in or unplugged. The shorting contact 64 may be an electrical conductor, and may be configured to complete a circuit between the positive polarity socket 8 and the negative polarity socket 10 during insertion/removal of the plug, allowing electricity to flow freely through the sockets, ultimately causing a fuse or breaker to trip. As illustrated in FIG. 5, the shielding ribs 54 may block the connection of the shorting contact 64 to the positive polarity socket 8 and negative polarity socket 10 when the plug is disconnected from the receptacle. Thus, in the unplugged configuration, the short circuit event may not occur, as depicted in the embodiment shown in FIG. 5. In this instance, power may be provided to the receptacle without tripping an upstream circuit breaker.

Figure 10:
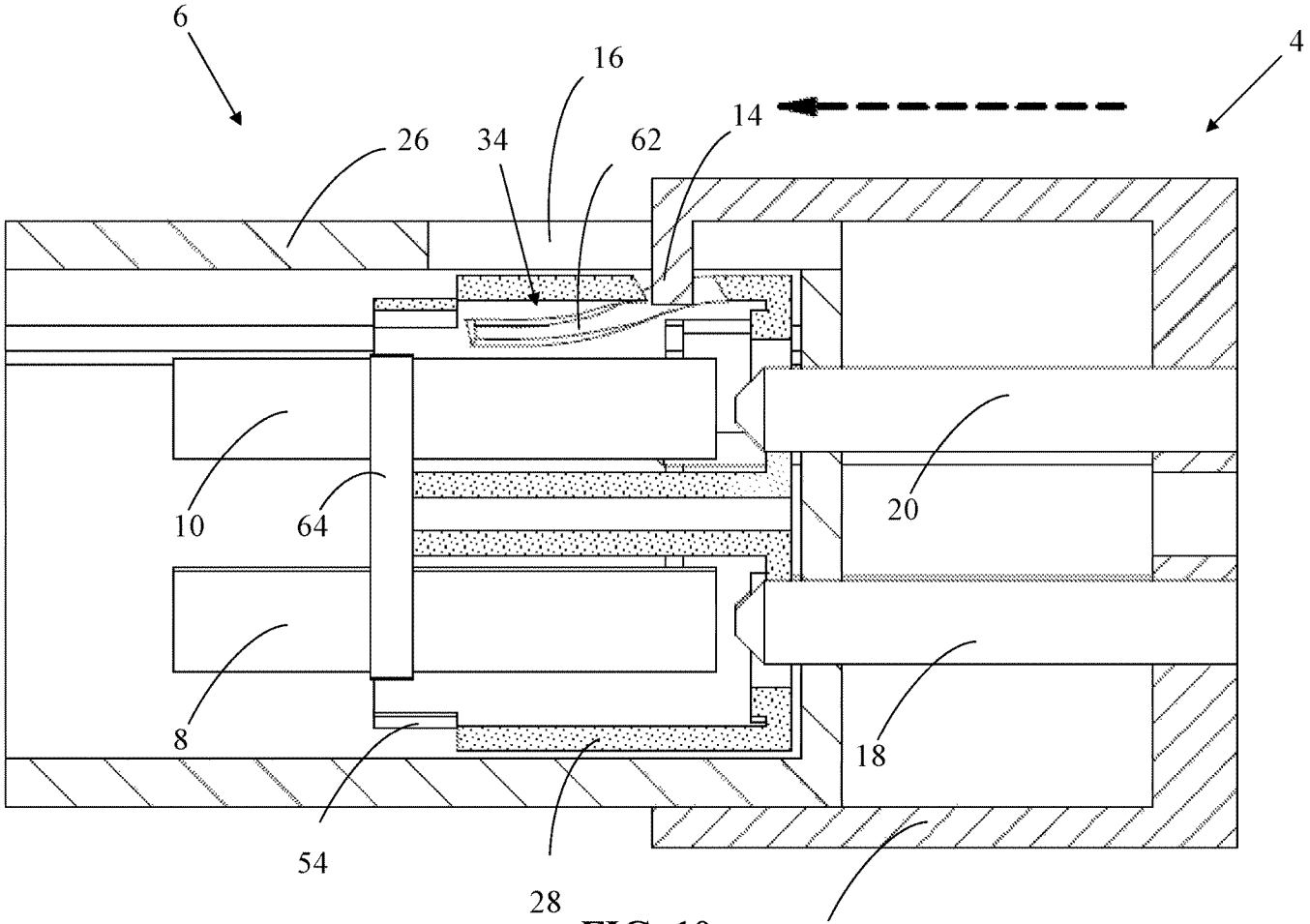
FIG. 10 illustrates a cross-sectional view of the plug initially engaging the receptacle, in accordance with embodiments of the present disclosure.

As shown in FIG. 6, however, as the plug begins entering the receptacle (though the pins do not yet enter the sockets, see. FIG. 10), the rotational shield 28 begins rotating. As the rotational shield rotates clockwise around the center point 42, the shielding ribs 54 expose the positive polarity socket 8 and negative polarity socket 10 to ends of the shorting contact 64. This may create a short circuit within the receptacle, and if power is provided to the receptacle, may trip an upstream circuit breaker, thus severing power to the receptacle. Accordingly, this may protect a user from an arc in the event that power is not removed from the receptacle prior to a plugging action (e.g., the user forgot to open the circuit breaker corresponding to the receptacle).

The shorting contact 64 may be mounted separately from the rotational shield 28, such that the shorting contact 64 does not rotate in synchronization with the rotational shield 28. This may allow the shielding ribs to rotate relative to the shorting contact 64, so that a short circuit event may be engaged upon rotation of the rotational shield 28. In some embodiments, the shorting contact 64 may be mounted to the stationary housing 26. This may allow the shorting contact 64 to remain stationary as the rotational shield 28 rotates. However, in some embodiments, the shorting contact 64 may rotate with the rotational shield 28. In these embodiments, the shielding ribs 54 may remain stationary as the shorting contact 64 rotates with the rotational shield 28. The shorting contact 64 may be mounted to the receptacle in any suitable manner, including adhesives, welding, soldering, and hardware assembly.

In some embodiments, the shorting contact 64 may be biased toward the sockets such that the shorting contact 64 contacts the positive polarity socket 8 and negative polarity socket 10 when the shielding ribs 54 rotate with the stationary housing 28. Accordingly, the shorting contact 64 may be constructed from a material (e.g., conductive materials such as copper and aluminum) with a spring back force. The spring back force may occur as a result of the shorting contact 64 material being biased toward its original shape. The bias of the shorting contact 64 may depend on placement of the shorting contact 64 relative to the positive polarity socket 8 and negative polarity socket 10.

The size and shape of the shorting contact 64 and shielding ribs 54 may vary, and may be constructed to facilitate the short circuit event. For example, in some embodiments, the shorting contact 64 may include ends disposed at an angle biased toward the positive polarity socket 8 and negative polarity socket 10. Further, in some embodiments, the shorting contact 64 end may include a portion biased away from the positive polarity socket 8 and negative polarity socket 10 (e.g., the "V" shaped ends of the shorting contact 64). This may allow the shorting contact 64 to contact the positive polarity socket 8 and negative polarity socket 10 at one point. The shielding ribs 54 may then be able to block this single contact point from completing the short circuit.

The shielding ribs 54 may include tapered ends to facilitate prying the shorting contact 64 off of the positive polarity socket 8 and negative polarity socket 10. As depicted in FIG. 5, the shielding ribs 54 pry the shorting contact 64 off of the positive polarity socket 8 and negative polarity socket 10. Referring now to FIG. 6, the shielding ribs 54 ends may be tapered to substantially match the angle of the shorting contact 64 end. This may allow the shielding ribs to easily slide along the angled end of the shorting contact 64, facilitating initiation and termination of the short circuit event. However, the relative size and shape of the shielding ribs 54 and shorting contact 64 may vary, and may depend on configuration of receptacle and plug. For example, in embodiments in which the shorting contact 64 is placed radially inward with respect to the sockets, the shorting contact 64 may be relatively smaller (e.g., compared to the embodiments shown in FIG. 5 and FIG. 6) and biased radially outward. In these embodiments, the shielding ribs 54 may be tapered at the opposite angle (e.g., perpendicular to the angle depicted on FIG. 5 and FIG. 6).

FIG. 5 and FIG. 6 additionally depict the functionality of the locking mechanism, in accordance with embodiments of the present disclosure. Referring to FIG. 5, the unlocking pin 40 may be offset with the locking latch receptacle 60. This may be because the unlocking pin hole (not shown, but currently enveloping the unlocking pin 40) of the stationary housing 26 may be offset with the unlocking pin receptacle 60. Specifically, the unlocking pin hole of the stationary housing 26 may be biased radially inward, such that the unlocking pin 40 may pull the locking latch 58 radially inward. To do so, the unlocking pin 40 may include a tapered edge, such that the unlocking pin receptacle 60 slides down the tapered edge of the unlocking pin 40, pulling the locking latch 58 radially inward, out of a locking latch aperture 66.

As shown in FIG. 6, the unlocking pin 40 may enter the unlocking pin receptacle 60 and pull the locking latch 58 radially inward. As the rotational shield 28 begins rotating, the locking latch 58 becomes flush with the inner wall of the stationary housing 26. Further, the unlocking pin 40 moves within the unlocking pin receptacle 60 as the rotational shield 28 rotates.

The unlocking pin receptacle 60, unlocking pin 40, locking latch 58, and locking latch aperture 66 may be any suitable size and shape. In some embodiments, the size and shape of the unlocking pin receptacle 60 may depend on the unlocking pin 40 and rotation of the rotational shield 28. In some embodiments, the unlocking pin receptacle 60 may have tapered edges, such that the unlocking pin 40 can slide against the tapered edges as it enters. In some embodiments, the unlocking pin receptacle 60 may be elongated, similar to as depicted in FIG. 5 and FIG. 6. This may allow the unlocking pin 40 to slide within the area of the unlocking pin receptacle 60 as the rotational shield 28 rotates. In some the width of the unlocking pin receptacle 60 may correspond directly to the width of the unlocking pin 40.

In some embodiments, the unlocking pin 40 may have tapered edges, to facilitate the unlocking pin 40 pulling radially inward on the unlocking pin receptacle 60. This may allow the unlocking pin receptacle 60 to easily slide along the edges (e.g., tapered or rounded) of the unlocking pin 40.

In some embodiments, the locking latch 58 may have a straight edge. The straight edge (e.g., as opposed to a tapered edge) may prevent the rotational shield 28 from unlocking without the unlocking pin 40 first disengaging the locking latch 58. Further, in some embodiments, the size and shape of the locking latch aperture 66 may correspond to the locking latch 58. Similarly, the locking latch aperture 66 may also include a straight edge, to prevent the locking latch 58 from disengaging the locking mechanism prior to the unlocking pin 40 entering the unlocking pin receptacle 60. It is to be understood that the size, shape, and arrangement of the locking latch 58, unlocking pin 40, unlocking pin receptacle 60, and locking latch aperture 66 are exemplary, and that any size, shape, or arrangement otherwise consistent with this disclosure is contemplated.

Further, FIG. 5 and FIG. 6 depict the rotation of the rotating pin holes 52 with respect to the sockets of the receptacle. As shown in FIG. 5, the rotating pin holes 52 may be offset from the sockets of the receptacle in the unplugged configuration. This may eliminate exposure to the sockets when the plug is not present, mitigating risk of electrocution and electric discharge to nearby objects. As the plug enters the receptacle, the clockwise rotation of the rotational shield 28 may cause the rotating pin holes 52 to begin aligning with the positive polarity socket 8, negative polarity socket 10, and ground socket 12, as illustrated in FIG. 6. This may allow the pins of the plug to access the plug during a plugging action.

Figure 7:
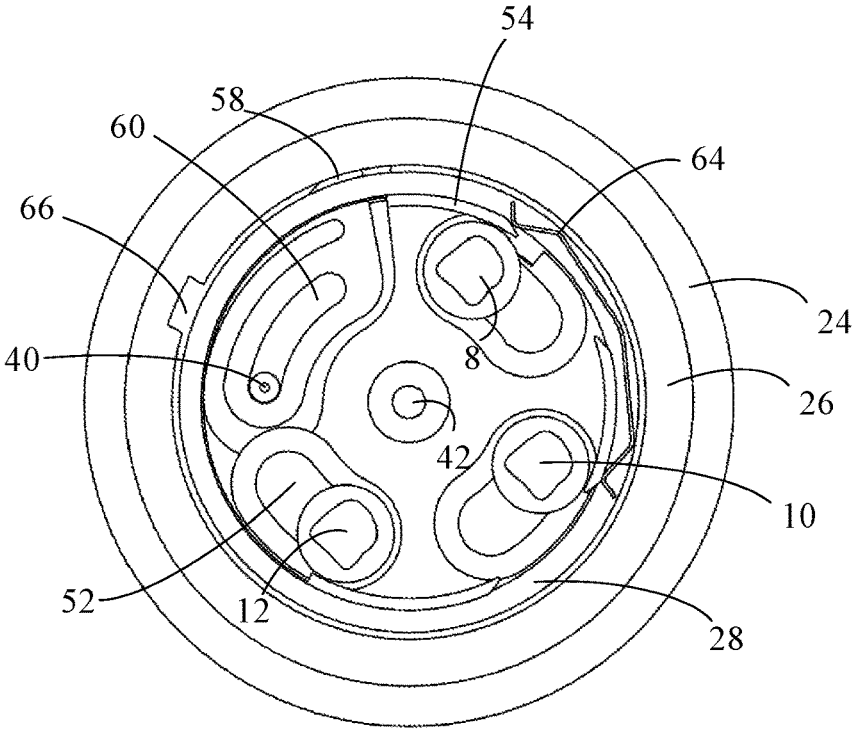
FIG. 7 illustrates a back view of the receptacle fully connected to the plug, in accordance with embodiments of the present disclosure.
Figure 8:
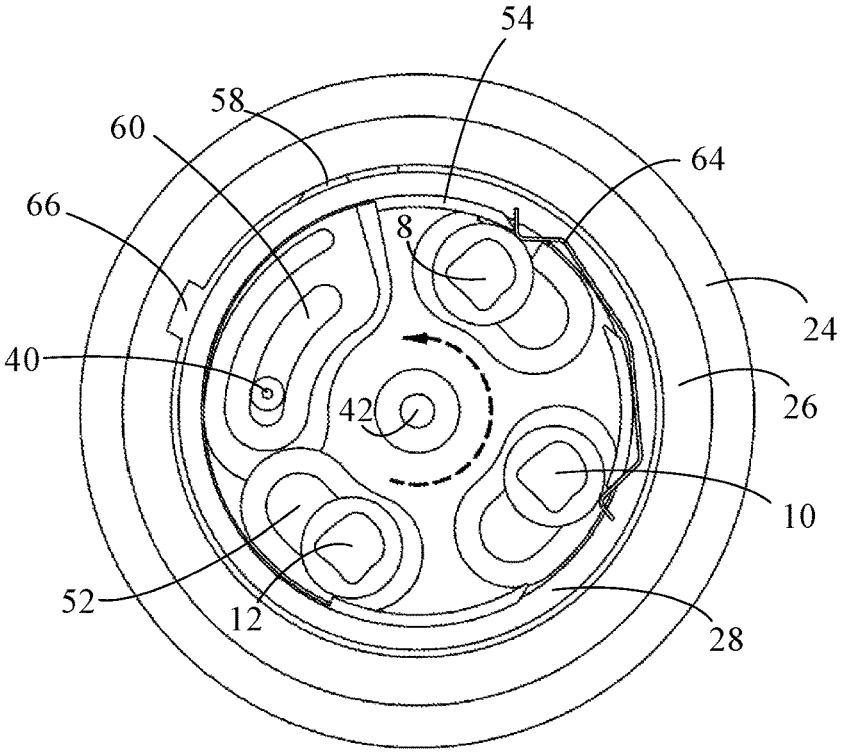
FIG. 8 illustrates a back view of the receptacle initially being disconnected from the plug, in accordance with embodiments of the present disclosure.

Referring now to FIG. 7 and FIG. 8, shown is a before and after comparison of the plug fully connected to the receptacle (FIG. 7), and the plug beginning to disconnect from the receptacle (FIG. 8). FIG. 7 depicts a back view of the receptacle fully coupled to the plug. FIG. 8 depicts a back view of the receptacle as the plug is initially being disconnected from the receptacle. As described and referenced in FIG. 7 and FIG. 8 the receptacle, plug, pins, and unlocking pin hole (not shown) may be substantially the same as the receptacle 6, plug 4, and pins, previously described.

As previously mentioned, in some embodiments, a short circuit event may be internally triggered within the receptacle when the plug begins disengaging the receptacle, prior to the pins separating from the sockets. The short circuit event may be configured to trip an upstream circuit breaker by allowing current to freely (e.g., with low resistivity) flow between two of the sockets, thus severing power to the receptacle. This may be completed to prevent an arc spawning between the pins and sockets through a plugging action. Specifically, the short circuit event may be triggered prior to prior to an air gap between pins of the plug and sockets of the receptacle being sufficiently small to allow arcing (e.g., which in this case represents a hot unplug situation, tripping the circuit breaker prior to the pins being disconnected from the sockets).

The receptacle may include shielding ribs 54 to block a short circuit event caused by the shorting contact 64 when the plug is substantially inserted into the receptacle. The shorting contact 64 may be configured to complete a circuit between the positive polarity socket 8 and the negative polarity socket 10. As can be seen in FIG. 7, the shielding ribs 54 block the connection of the shorting contact 64 to the positive polarity socket 8 and negative polarity socket 10. Thus, in the fully plugged configuration, the short circuit event may not occur, as depicted in the embodiment shown in FIG. 7. In this instance, power may be provided to the receptacle and, ultimately, to the connected electronic device(s) without tripping an upstream circuit breaker.

Figure 12:
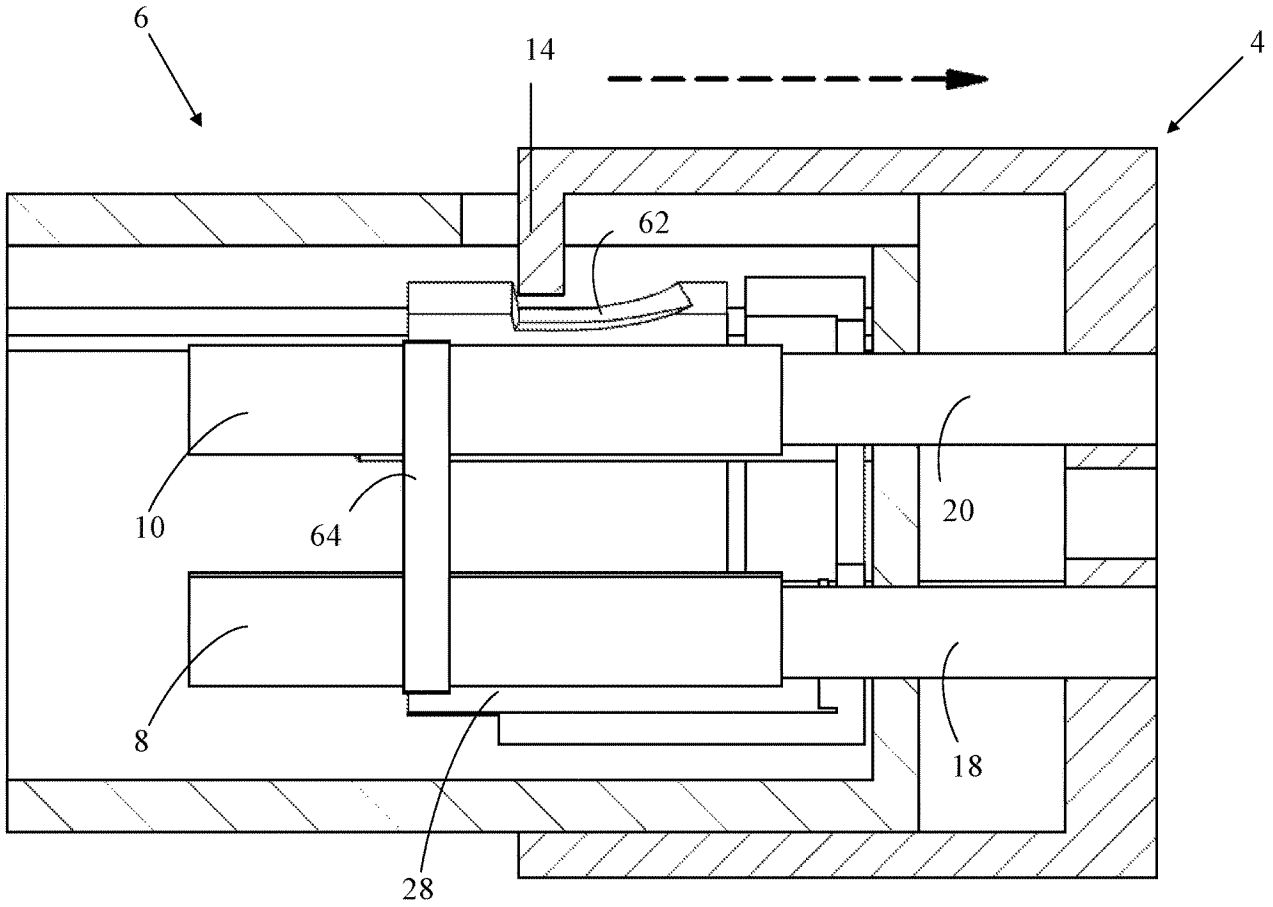
FIG. 12 illustrates a cross-sectional view of the plug being disconnected from the receptacle, in accordance with embodiments of the present disclosure.

As shown in FIG. 8, however, the plug begins disengaging the receptacle (though the pins do not separate from the sockets yet, see. FIG. 12) and the rotational shield 28 begins rotating. As the rotational shield rotates counter-clockwise around the center point 42, the shielding ribs 54 expose the positive polarity socket 8 and negative polarity socket 10 to ends of the shorting contact 64. This creates a short circuit within the receptacle, and if power is provided to the receptacle, may trip an upstream circuit breaker, thus severing power to the receptacle. Accordingly, this may protect a user from an arc in the event that power is not removed from the receptacle prior to a plugging action (e.g., the user forgot to open the circuit breaker corresponding to the receptacle), as the circuit may be tripped prior to the pins fully disengaging the sockets.

Further, FIG. 7 and FIG. 8 depict the rotation of the rotating pin holes 52 with respect to the sockets of the receptacle. As shown in FIG. 7, the rotating pin holes 52 may be aligned with the sockets of the receptacle in the fully plugged configuration. This may allow the pins of the plug to mate with the sockets of the receptacle, when the plug is coupled to the receptacle. As the plug disengages the receptacle, the counter-clockwise rotation of the rotational shield 28 may cause the rotating pin holes 52 to shift in a direction to become offset with the positive polarity socket 8, negative polarity socket 10, and ground socket 12, as illustrated in FIG. 8. This may eliminate exposure to the sockets when the plug is not present, mitigating risk of electrocution and electric discharge to nearby objects. However, because the pins are still connected to the sockets during FIG. 8 (e.g., see FIG. 11), the rotating pin holes 52 may be elongated, such that the pins may stay connected to the sockets during this period of disengagement.

FIG. 7 and FIG. 8 additionally depict the functionality of the locking mechanism, in accordance with embodiments of the present disclosure. Referring to FIG. 7, the unlocking pin 40 may be positioned against an end of the unlocking pin receptacle 60 (e.g., fully plugged configuration of the unlocking pin 40). As the rotational shield 28 begins rotating counter-clockwise around the center point 42, the unlocking pin 40 may begin moving radially counter-clockwise toward an opposite end of the unlocking pin receptacle 60. As this occurs, the locking latch 58 rests flush against the inner wall of the stationary housing 26, until the plug is fully disconnected from the receptacle, at which point the locking latch 58 may enter the locking latch aperture 66.

Figure 9:
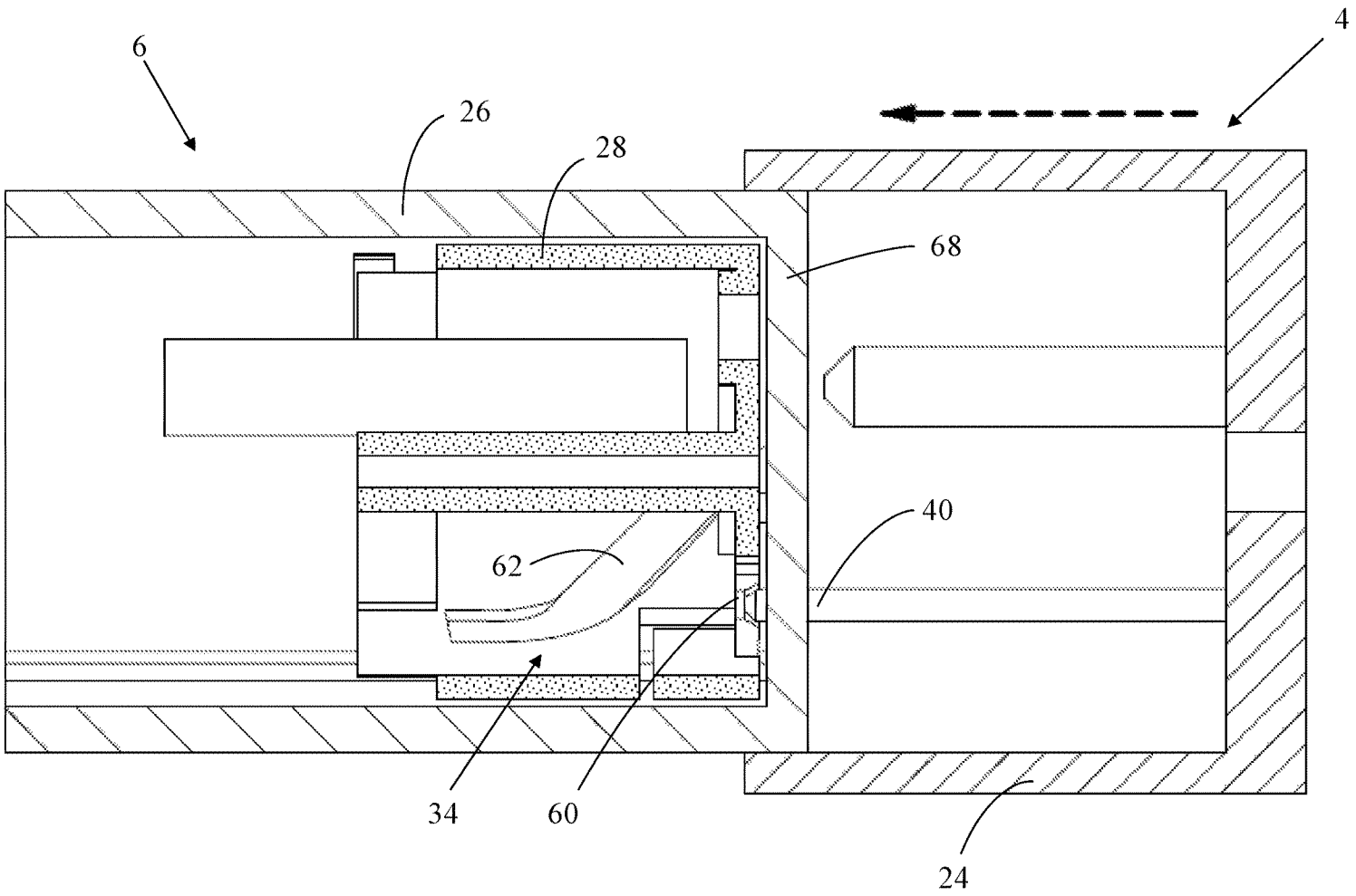
FIG. 9 illustrates a cross-sectional view of an unlocking pin disengaging a locking mechanism in the receptacle, in accordance with embodiments of the present disclosure.

FIG. 9 illustrates a cross-sectional view of the unlocking pin 40 of the plug 4 engaging the unlocking pin receptacle 60 of the receptacle 6, in accordance with embodiments of the present disclosure. As described in FIG. 9, the actuation key and actuation track may be substantially the same as the actuation key 14 and actuation track 16 previously described.

The unlocking pin 40 may engage the unlocking pin receptacle 60 prior to the actuation key of the plug 4 entering the pitch region 62 of the rotational shield track 34. This may prevent the rotational shield 28 from rotating, or being subjected to rotational forces, prior to being unlocked by the unlocking pin 40. In some embodiments, the actuation key of the plug 4 may engage the actuation track of the stationary housing 26 as the unlocking pin 40 engages the unlocking pin receptacle 60. This may occur at the point the plug 4 initially engages the rotational shield 28, when the plug 4 passes the front face 68 of the stationary housing 26. Therefore, the actuation track of the stationary housing 26 and rotational shield track 34 of the rotational shield 28 may be offset by the thickness of the front face 68 of the stationary housing.

However, in some embodiments, the unlocking pin 40 may extrude beyond the front face of the plug 4 such that the unlocking pin 40 disengages the locking mechanism prior to the plug 4 enveloping the receptacle 6. This may also ensure that the rotational shield 28 locking mechanism is disengaged prior to the actuation key entering the pitch region 62 of the rotational shield track 34.

FIG. 10 illustrates a cross-sectional view of the plug 4 entering the receptacle 6, in accordance with embodiments of the present disclosure. As the plug housing 24 envelopes the stationary housing 26, the actuation key 14 may first enter the actuation track 16. The actuation key 14 may then enter into the pitch region 62 of the rotational shield track 34 as the plug 4 progresses further into the receptacle 6.

As the actuation key 14 moves along the depth of the pitch region 62, the rotational shield 28 may rotate. Accordingly, shielding ribs 54 of the rotational shield 28 may rotate and allow the shorting contact 64 to contact to the positive polarity socket 8 and negative polarity socket 10. By completing a short circuit between the opposite polarity sockets, the shorting contact 64 may trip an upstream circuit breaker.

As depicted in FIG. 10, the short circuit event may be initiated prior to the positive and negative polarity pins 18, 20 inserting into the positive and negative polarity sockets 8, 10 respectively. This may be completed to prevent an arc from spawning between the pins and sockets. Accordingly, the short circuit event may be triggered prior to the pins reaching a separation distance from the sockets sufficient to spawn an arc, preventing a hot plug arc (e.g., hot plugging). In some embodiments, the distance at which the short circuit event is triggered may depend on the facility power provided to the receptacle 6. For example, if a greater voltage/current is provided to the receptacle 6, the short circuit event may be triggered at a greater separation distance between the pins and sockets (e.g., as the arc may spawn at a greater separation distance in accordance with Paschen's Law).

Figure 11:
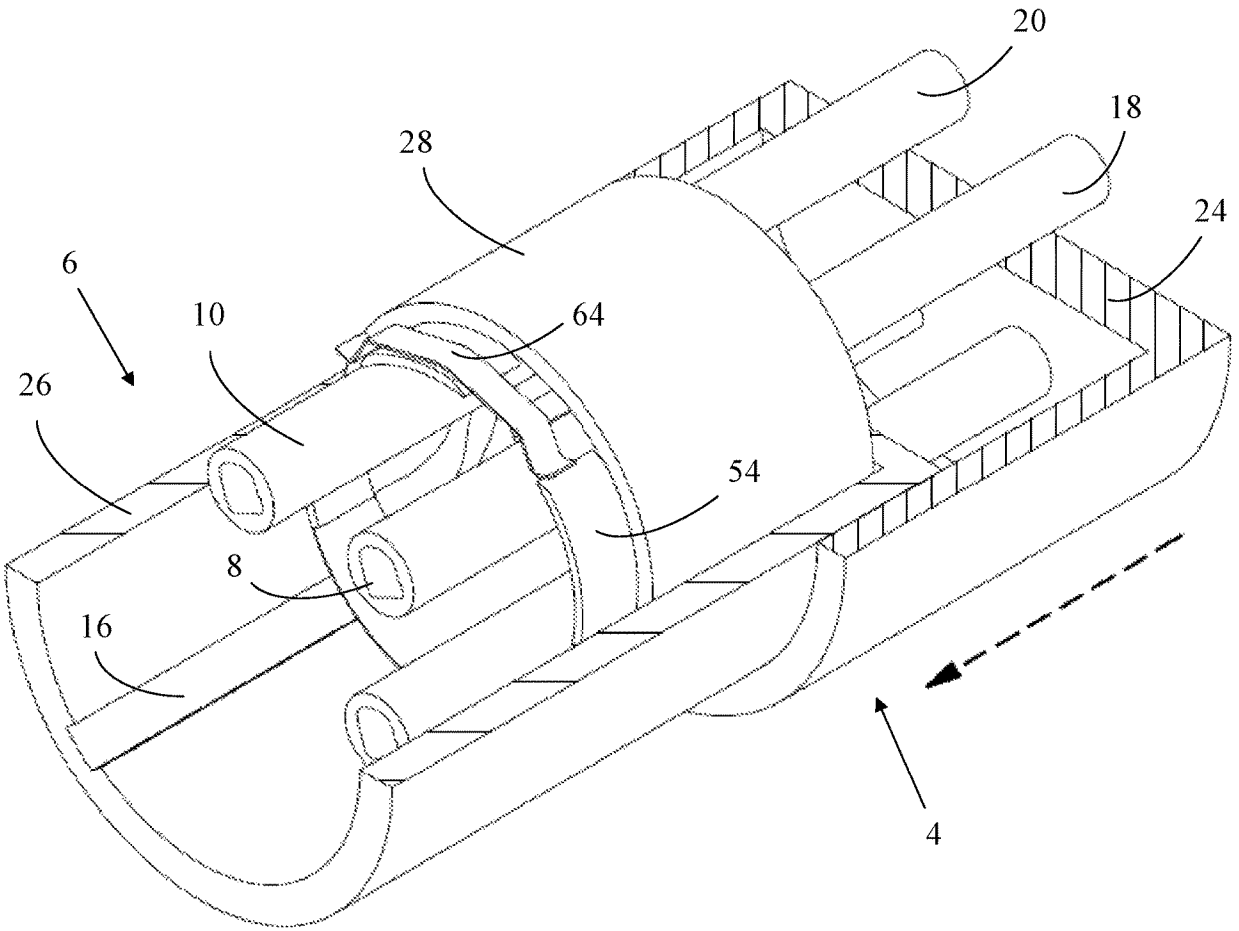
FIG. 11 illustrates a perspective view of the plug entering the receptacle, with cross-sections of the stationary housing and plug housing, in accordance with embodiments of the present disclosure.

FIG. 11 illustrates a perspective view of the plug 4 entering the receptacle 6, with the stationary housing 26 and plug housing 24 cross-sectioned, in accordance with embodiments of the present disclosure. As described in FIG. 11, the actuation key may be substantially the same as the actuation key 14 previously described.

As the plug 4 is inserted into the receptacle 6 (e.g., or vice versa), the plug housing 24 may envelope the stationary housing 26 (e.g., following the directional arrow). As the actuation key moves along the actuation track 16, the rotational shield 28 may rotate via the rotational shield track. Accordingly, the shielding ribs 54 of the rotational shield 28 may rotate, and may expose the positive polarity socket 8 and negative polarity socket 10 to the shorting contact 64 (e.g., as the shorting contact may remain stationary, as previously described). This may complete a short circuit as the plug 4 is being inserted into the receptacle 6. As mentioned in FIG. 10, the short circuit event may be initiated prior to the positive and negative polarity pins 18, 20 reaching the positive and negative polarity sockets 8, 10 respectively. This may trip an upstream circuit breaker, and may sever power to the receptacle 6 prior to the pins reaching a proximity of the sockets sufficient to spawn an arc.

FIG. 12 illustrates a cross-sectional view of the plug 4 exiting the receptacle 6, in accordance with embodiments of the present disclosure. As described in FIG. 12, the shielding ribs may be substantially the same as the shielding ribs 54 previously described.

As the plug 4 moves in a direction away from the receptacle 6 (e.g., following the directional arrow), the actuation key 14 may enter the pitch region 62. Following the curve of the pitch region 62, the rotational shield 28 may rotate, and the shielding ribs may allow the shorting contact 64 to contact the positive polarity socket 8 and negative polarity socket 10. This may initiate a short circuit event as the plug 4 is being removed from the receptacle 6. The short circuit event may occur prior to the positive polarity pin 18 and negative polarity pin 20 exiting the positive polarity socket 8 and negative polarity socket 10 respectively. This may prevent an arc from spawning in an air gap between the pins and sockets. Accordingly, the short circuit event may initiate prior to the pins exiting the receptacles to provide protection against a hot unplug arc (e.g., hot unplugging).

Figure 13:
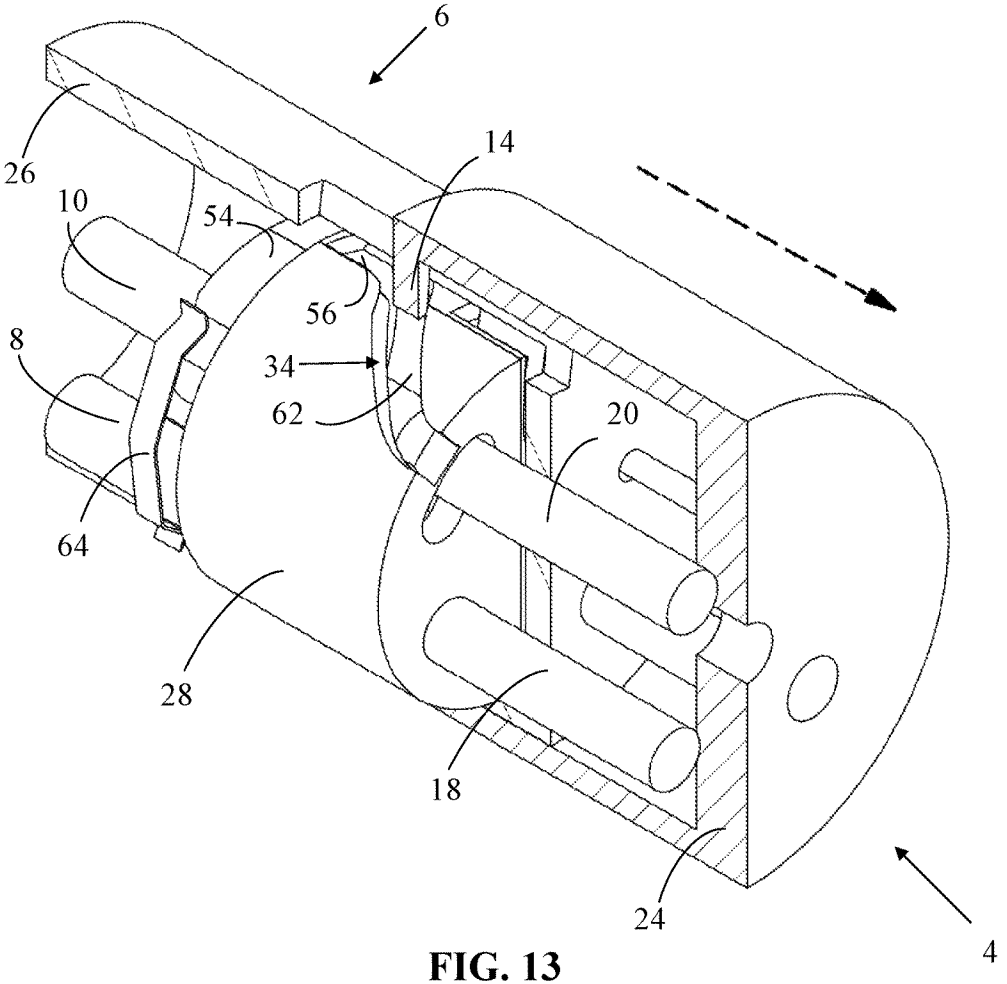
FIG. 13 illustrates a perspective view of the plug being disconnected from the receptacle, with cross-sections of the stationary housing and plug housing, in accordance with embodiments of the present disclosure.

FIG. 13 illustrates a perspective view of the plug 4 being removed from the receptacle 6, with the plug housing 24 and stationary housing 26 cross-sectioned, in accordance with embodiments of the present disclosure.

As the plug 4 is being removed from the receptacle 6 (e.g., following the directional line), or vice versa, the actuation key 14 may slide out of the plateau region 56 of the rotational shield track 34 and into the pitch region 62 of the rotational shield track. This may begin rotation of the rotational shield 28, and thus may shift the location of the shielding ribs 54 with respect to the shorting contact 64 (e.g., as the shorting contact 64 may be stationary). The shorting contact 64 may then contact the positive and negative polarity sockets 8, 10, thereby creating a short circuit event. The short circuit event may trip an upstream circuit breaker, and may remove power to the receptacle 6. The short circuit event may occur prior to the positive and negative polarity pins 18, 20 of the plug 4 exiting the positive and negative polarity sockets 8, 10 of the receptacle 6 (e.g., see FIG. 12). This may provide protection against a hot-unplug arc.

Figure 14:
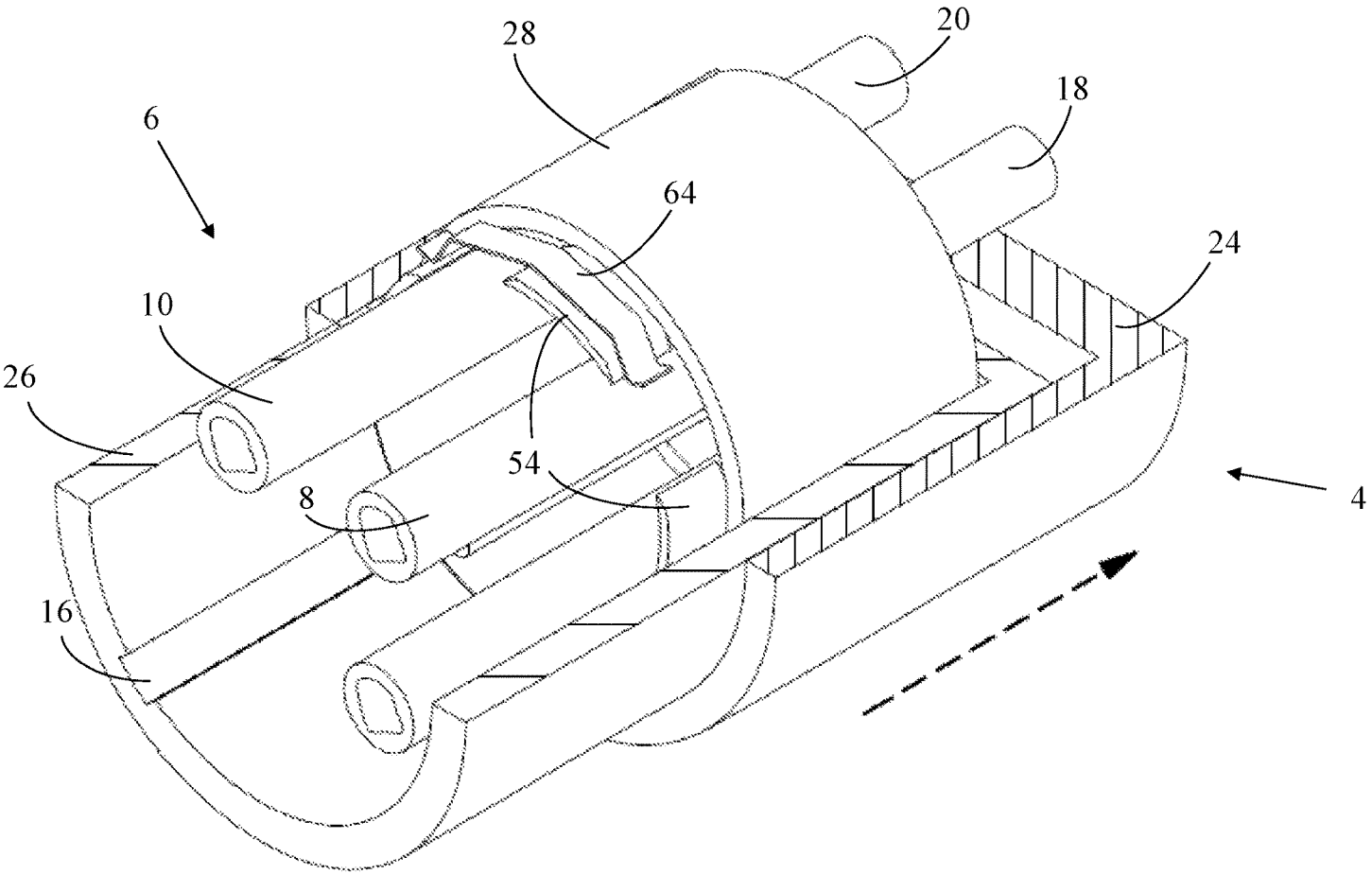
FIG. 14 illustrates a second perspective view of the plug being disconnected from the receptacle, with cross-sections of the stationary housing and plug housing, in accordance with embodiments of the present disclosure.

FIG. 14 illustrates a second perspective view of the plug 4 being disconnected from the receptacle 6, with cross-sections of the stationary housing 26 and plug housing 24, in accordance with embodiments of the present disclosure. The second perspective view is a view proximate to the receptacle 6. As described in FIG. 14, the actuation key and rotational shield track may be substantially the same as the actuation key 14 and rotational shield track 34 previously described.

As the plug 4 is removed from the receptacle 6 (e.g., or vice versa), the actuation key of the plug 4 may move along the actuation track 16 of the stationary housing 26. As the actuation key moves along the actuation track 16, the rotational shield 28 may rotate via the rotational shield track. Accordingly, the shielding ribs 54 of the rotational shield 28 may rotate, and may expose the positive polarity socket 8 and negative polarity socket 10 to the shorting contact 64 (e.g., as the shorting contact may remain stationary, as previously described). This may complete a short circuit as the plug 4 is being removed from the receptacle 6. As mentioned in FIG. 12, the short circuit event may be initiated while the positive and negative polarity pins 18, 20 are still connected to the positive and negative polarity sockets 8, 10 respectively. This may trip an upstream circuit breaker, and may sever power to the receptacle prior to the pins exiting the sockets, preventing an arc from spawning in an airgap between the pins and sockets.

Figure 15:
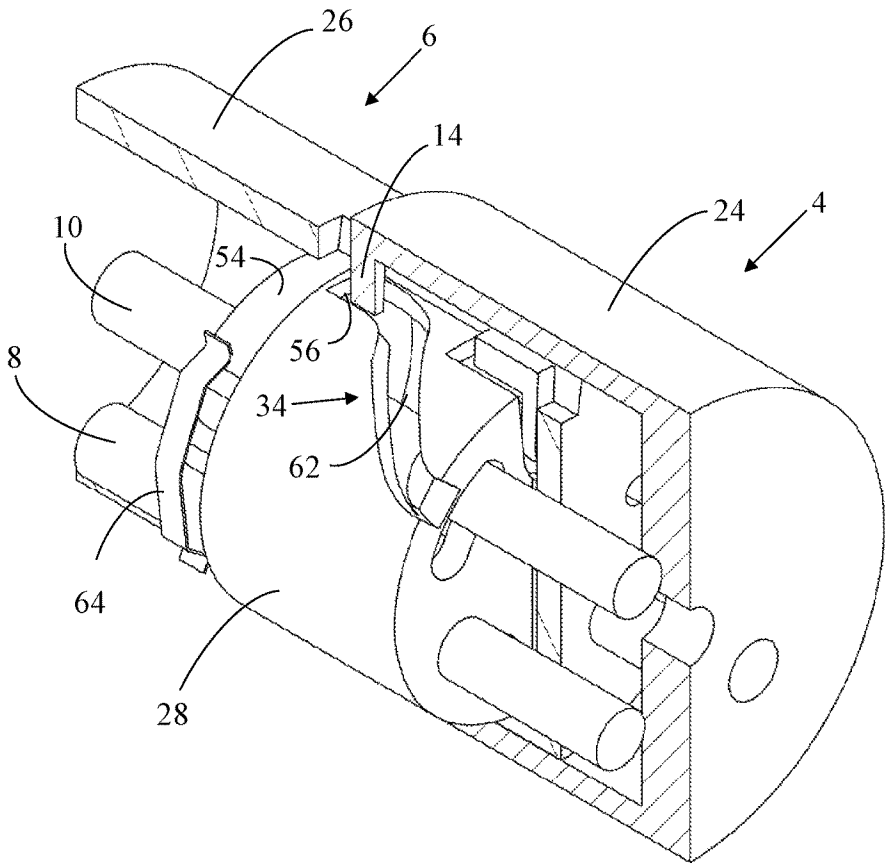
FIG. 15 illustrates a perspective view of the plug fully connected to the receptacle, with cross-sections of the stationary housing and plug housing, in accordance with embodiments of the present disclosure.

FIG. 15 illustrates a perspective view of the plug 4 fully inserted into the receptacle 6, with cross-sections of the stationary housing 26 and plug housing 24, in accordance with embodiments of the present disclosure. As described in FIG. 15, the rotating pin holes, pin holes, unlocking pin, unlocking pin receptacle, locking mechanism, locking latch, and locking latch aperture may be substantially the same as the rotating pin holes 52, pin holes 46, unlocking pin 40, unlocking pin receptacle 60, locking mechanism 50, locking latch 58 and locking latch aperture 66 previously described.

As the plug 4 fully inserts into the receptacle 6, the actuation key 14 of the plug 4 may exit the pitch region 62 of the rotational shield track 34 and may enter the plateau region 56 of the rotational shield track. At the plateau region 56, the rotation of the rotational shield 28 may cease (e.g., or gradually cease), and the shielding ribs 54 may be configured to block the shorting contact 64 from contacting the positive polarity socket 8 and negative polarity socket 10. Accordingly, in the fully plugged configuration, the shielding ribs 54 may block the shorting contact 64 from initiating a short circuit event. Power may then be provided to the receptacle 6 in a fully plugged configuration (e.g., by turning on an upstream circuit breaker), as the short circuit event is blocked.

Components of the plug 4 and receptacle 6 may be manufactured with any suitable manufacturing method. Potential manufacturing methods may include CNC milling, laser cutting, plasma cutting, hydraulic punching, waterjet cutting, hydraulic bending, 3D printing, machining, lathe cutting, and the like. In some embodiments, the pins, sockets, unlocking pin, rotational shield 28, plug housing 24 and stationary housing 26 may be fabricated with a lathe, due to their circular geometries. In some embodiments, the rotational shield track may be laser cut. In some embodiments, the rotating pin holes, pin holes, unlocking pin hole, and unlocking pin receptacle may be formed by cutting, pressing, or punching.

Further, components of the plug 4 and receptacle 6 may be manufactured using any suitable material, including conductive materials (e.g., copper, aluminum, and graphite, to name a few) and non-conductive materials (e.g., rubber, plastics, and fabric, to name a few). The pins, sockets, and shorting contact 64, in some embodiments, may be constructed from conductive materials. In some embodiments, the stationary housing 26, rotational shield 28, shielding ribs 54, actuation key 14, and plug housing 24 may be constructed from non-conductive materials. In some embodiments, the shorting contact 64 may be manufactured from a conductive material with a spring back force, such that the shorting contact 64 is biased toward the sockets. In some embodiments, the actuation key 14 and rotational shield track 34 may be manufactured from materials that allow the actuation key 14 to easily slide within the rotational shield track 34 (e.g., low friction). Further, the rotational shield track 34 and/or actuation key 14 may include lubricant (e.g., oil, grease, graphite) to facilitate the actuation key 14 sliding within the rotational shield track 34 by preventing friction. In some embodiments, the locking mechanism may be manufactured from a material with a spring back force to allow the locking latch to remain in the locking latch aperture when the plug 4 is not connected to the receptacle 6.

In some embodiments, the plug 4 and receptacle 6 may be additively manufactured (e.g., 3D printed). In these embodiments, the desired geometries may be input into a computer, and the computer may cause an additive manufacturing machine to produce the plug 4 and receptacle 6.

The aforementioned manufacturing methods may be completed by a computer (e.g., by a processor connected to a memory device that includes computer code to cause the process to perform the aforementioned operations). Likewise, the computer may cause another machine to complete the aforementioned manufacturing methods. In some embodiments, a user defines the dimension of the plug 4 and receptacle 6. The computer may then cause a machine to make the desired plug 4 and receptacle 6. Various machines may be instructed to manufacture the plug 4 and receptacle 6, including hydraulic benders, CNC Mills, waterjet cutters, plasma cutters, laser cutters, flame cutters, 3D printers, hydraulic punching presses, and the like.

As discussed in more detail herein, it is contemplated that some or all of the operations of some of the embodiments of methods described herein may be performed in alternative orders or may not be performed at all; furthermore, multiple operations may occur at the same time or as an internal part of a larger process.

The terminology used herein is for the purpose of describing particular embodiments only and is not intended to be limiting of the various embodiments. As used herein, the singular forms "a," "an," and "the" are intended to include the plural forms as well, unless the context clearly indicates otherwise. It will be further understood that the terms "includes" and/or "including," when used in this specification, specify the presence of the stated features, integers, steps, operations, elements, and/or components, but do not preclude the presence or addition of one or more other features, integers, steps, operations, elements, components, and/or groups thereof. In the previous detailed description of example embodiments of the various embodiments, reference was made to the accompanying drawings (where like numbers represent like elements), which form a part hereof, and in which is shown by way of illustration specific example embodiments in which the various embodiments may be practiced. These embodiments were described in sufficient detail to enable those skilled in the art to practice the embodiments, but other embodiments may be used and logical, mechanical, electrical, and other changes may be made without departing from the scope of the various embodiments. In the previous description, numerous specific details were set forth to provide a thorough understanding the various embodiments. But, the various embodiments may be practiced without these specific details. In other instances, well-known circuits, structures, and techniques have not been shown in detail in order not to obscure embodiments.

Different instances of the word "embodiment" as used within this specification do not necessarily refer to the same embodiment, but they may. The previous detailed description is, therefore, not to be taken in a limiting sense.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

Although the present invention has been described in terms of specific embodiments, it is anticipated that alterations and modification thereof will become apparent to the skilled in the art. Therefore, it is intended that the following claims be interpreted as covering all such alterations and modifications as fall within the true spirit and scope of the invention.

What is claimed is:

1. A system comprising:

a plug, wherein the plug includes two or more pins; and a receptacle, wherein the receptacle is configured to receive power and further comprises:

two or more sockets configured to electrically couple to the two or more pins;

a shorting contact, wherein the shorting contact is configured to contact two sockets of the two or more sockets; and a rotational shield, wherein the rotational shield includes shielding ribs, the shielding ribs being configured to block the shorting contact from contacting the two sockets.

2. The system of claim 1, wherein the shielding ribs are configured to block the shorting contact from contacting the two sockets when the plug is entirely disconnected from the receptacle and when the plug is entirely connected to the receptacle.

3. The system of claim 1, wherein the shorting contact is configured to contact the two sockets during a plugging action, wherein the shorting contact is configured to open an upstream circuit breaker when contacting the two sockets.

4. The system of claim 1, wherein the rotational shield further comprises a locking latch, the locking latch being configured to prevent the rotational shield from rotating when the plug is not connected to the receptacle.

5. The system of claim 4, wherein the plug further comprises an unlocking pin, wherein the unlocking pin is configured to unlock the locking latch.

6. The system of claim 1, wherein the plug further comprises an actuation key, and wherein the rotational shield further comprises a rotational shield track, wherein the actuation key is configured to slide through the rotational shield track causing the rotational shield to rotate.

7. The system of claim 1, wherein the rotational shield further comprises rotating pin holes, wherein the rotating pin holes are configured to block access to the two or more sockets when the plug is not connected to the receptacle.

8. The system of claim 1, wherein the receptacle further comprises a stationary housing, wherein the stationary housing encompasses the rotational shield and further comprises two or more pin holes corresponding to and aligned with the two or more pins of the plug.

9. A power receptacle comprising:

two or more sockets configured to electrically couple to two or more pins of a power plug;

a shorting contact, wherein the shorting contact is configured to contact two sockets of the two or more sockets; and a rotational shield, wherein the rotational shield includes shielding ribs, the shielding ribs being configured to block the shorting contact from contacting the two sockets.

10. The power receptacle of claim 9, wherein the shielding ribs are configured to block the shorting contact from contacting the two sockets when the power plug is entirely disconnected from the power receptacle and when the power plug is entirely connected to the power receptacle.

11. The power receptacle of claim 9, wherein the shorting contact is configured to contact the two sockets during a plugging action, wherein the shorting contact is configured to open an upstream circuit breaker when contacting the two sockets.

12. The power receptacle of claim 9, wherein the rotational shield further comprises a locking latch, the locking latch being configured to prevent the rotational shield from rotating when the power plug is not connected to the power receptacle.

13. The power receptacle of claim 9, wherein the power plug further comprises an actuation key, and wherein the rotational shield further comprises a rotational shield track, wherein the actuation key is configured to slide through the rotational shield track causing the rotational shield to rotate.

14. The power receptacle of claim 9, wherein the rotational shield further comprises rotating pin holes, wherein the rotating pin holes are configured to block access to the two or more sockets when the plug is not connected to the receptacle.

15. The power receptacle of claim 9, wherein the power receptacle further comprises a stationary housing, wherein the stationary housing encompasses the rotational shield and further comprises two or more pin holes corresponding to and aligned with the two or more pins of the power plug.

16. A power plug comprising:

two or more pins, wherein the two or more pins are configured to electrically couple to two or more sockets of a power receptacle; and an actuation key, wherein the actuation key is configured to slide within a rotational shield track of a rotational shield of a receptacle, wherein the actuation key is configured to cause the rotational shield to rotate as the actuation key slides within the rotational shield track, wherein the rotational shield includes shielding ribs and a shorting contact, wherein the shorting contact is configured to contact two sockets of the two or more sockets, and wherein the shielding ribs are configured to block the shorting contact from contacting the two sockets.

17. The power plug of claim 16, wherein the shielding ribs are configured to block the shorting contact from contacting the two sockets when the power plug is entirely disconnected from the power receptacle and when the power plug is entirely connected to the power receptacle.

18. The power plug of claim 16, wherein the shorting contact is configured to contact the two sockets during a plugging action, wherein the shorting contact is configured to open an upstream circuit breaker when contacting the two sockets.

19. The power plug of claim 16, wherein the rotational shield further comprises a locking latch, the locking latch being configured to prevent the rotational shield from rotating when the plug is not connected to the receptacle.

20. The power plug of claim 19, wherein the power plug further comprises an unlocking pin, wherein the unlocking pin is configured to unlock the locking latch.

* * * * *